US007537332B2

(12) United States Patent
Nakazawa

(10) Patent No.: US 7,537,332 B2
(45) Date of Patent: May 26, 2009

(54) INK-JET RECORDING DEVICE

(75) Inventor: Yusuke Nakazawa, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 390 days.

(21) Appl. No.: 11/481,013

(22) Filed: Jul. 6, 2006

(65) Prior Publication Data

US 2007/0019051 A1 Jan. 25, 2007

(30) Foreign Application Priority Data

Jul. 19, 2005 (JP) ..... P.2005-209138

(51) Int. Cl.
*B41J 2/01* (2006.01)

(52) U.S. Cl. ..... 347/102; 347/103

(58) Field of Classification Search ..... 347/103, 347/102

See application file for complete search history.

(56) References Cited

U.S. PATENT DOCUMENTS 7,080,900 B2 * 7/2006 Takabayashi et al. ..... 247/102
2006/0055757 A1 * 3/2006 Yamashita et al. ..... 347/102
2007/0030334 A1 * 2/2007 Nishizawa ..... 347/245

FOREIGN PATENT DOCUMENTS

| | | |
|---|---|---|
| CN | 2532910 | 1/2003 |
| JP | 2003-200564 A | 7/2003 |
| JP | 2005-070264 A | 3/2005 |

OTHER PUBLICATIONS

Chinese Office Action dated May 9, 2008.

* cited by examiner

*Primary Examiner*—Stephen D Meier
*Assistant Examiner*—Ly T Tran
(74) *Attorney, Agent, or Firm*—Sughrue Mion, PLLC

(57) ABSTRACT

An ink-jet recording device including: an irradiating unit that irradiates an ultraviolet ray, an ink-jet head that ejects an ink toward a recording medium, the ink capable of curing by the ultraviolet ray irradiated from the irradiating unit, a conveying unit that conveys the recording medium to a position opposed to the ink-jet head, and a filter unit including a photocatalyst activated by the ultraviolet ray.

6 Claims, 5 Drawing Sheets

INK-JET RECORDING DEVICE

BACKGROUND OF THE INVENTION

1. Field of the Invention

The present invention relates to an ink-jet recording device which allows an ultraviolet-curable ink to be ejected onto a recording medium to form an image thereon and more particularly to an ink-jet recording device free from an ink odor.

2. Background Art

An ink-jet recording device which ejects an ultraviolet-curable ink through an ink-jet-head onto a recording medium where it is then irradiated with ultraviolet ray and cure to effect image formation is characterized in that it is environmentally friendly, can make high speed recording on various recording media and provides a highly fine image with little bleeding (see, e.g., JP-A-2003-200564 (the term "JP-A" as used herein means an "unexamined published Japanese patent application)).

FIG. 5 is a schematic drawing that illustrates construction of a conventional ink-jet recording device of a roller conveying type. In this figure, the reference numeral 500 indicates the ink-jet recording device of the roller conveying type. The ink-jet recording device of the roller conveying type has a housing 12 in which there are provided a recording medium housing portion 20, a conveying portion 30 for retrieving a recording medium S from the housing portion 20, a conveying and supporting portion 40, an image recording portion 50 and a tray 90 onto which a recording medium S which has been subjected to recording in the image forming portion 50 is delivered.

In the recording medium housing portion 20, a housing cassette 22 for housing the recording medium S is detachably disposed under the housing 12.

In the conveying portion 30, the recording medium S is conveyed from the housing cassette 22 to the scanning/retaining portion 40.

The conveying and supporting portion 40 has a flat platen 41. Conveying rollers 36, 42 are provided both front and rear the platen 41, respectively. These conveying rollers are rotated in the predetermined respective direction. As the conveying rollers 36, 42 rotate, the recording medium S is conveyed from the conveying roller 36 to the conveying roller 42.

In the image recording portion 50 is provided a head unit 52. The head unit 52 ejects an ink image-wise from the various ink ejection portions on the recording medium S at predetermined positions. To each of the various head units 52 is connected a head driver 54 which controls the amount of the ink to be ejected through the various ink ejection nozzles. To each of these head units 52 is connected a supplying portion 70 which supplies the respective ink.

An ultraviolet ray irradiating portion 56 is disposed down the head unit 52 shortly after the image recording position. The ultraviolet ray irradiating portion 56 is adapted to irradiate the ink dropped on the recording medium S with ultraviolet ray so that the ink is immediately cured.

The tray 90 receives sequentially sheets of recording media S driven by the conveying roller 42 to form a stack of recording media S.

In order to inhibit the rise of temperature in the housing 12 due to the irritating light used in the curing of the ink in the ultraviolet ray irradiating portion 56, a ventilation cooling portion 80 is provided at the upper portion in the housing 12. The internal air is exhausted out of the device through the ventilation cooling portion 80.

Thus, the ink-jet recording device which ejects an ultraviolet-curable ink through an ink-jet head onto a recording medium where it is then irradiated with ultraviolet ray and cure to effect image formation is characterized in that it can make high speed recording on various recording media and provide a highly fine image with little bleeding.

On the other hand, however, the ink-jet head can difficultly eject a highly viscous ink. Thus, the head is driven while being heated to reduce the viscosity of the ink during drawing. In order to reduce the essential viscosity of ultraviolet-curable ink, an ink containing a volatile curable component is used. Accordingly, such an ink is disadvantageous in that it has an odor and the volatile component gives unpleasant feeling to human being.

SUMMARY OF THE INVENTION

An objection of the invention is to provide an ink-jet recording device which can form a high quality image at an excellent productivity without generating volatile components.

The object of the invention has been accomplished by the following constructions.

(1) An ink-jet recording device comprising: an irradiating unit that irradiates an ultraviolet ray, an ink-jet head that ejects an ink toward a recording medium, the ink capable of curing by the ultraviolet ray irradiated from the irradiating unit, a conveying unit that conveys the recording medium to a position opposed to the ink-jet head, and a filter unit comprising a photocatalyst activated by the ultraviolet ray.

(2) The ink-jet recording device as described in the item (1), wherein the filter unit comprises a titanium oxide.

(3) The ink-jet recording device as described in the item (1) or (2), wherein the filter unit is disposed on a line in an irradiating direction of the ultraviolet ray irradiated from the irradiating unit toward the recording medium and on a side of the recording medium opposite the irradiating unit, and the filter unit is irradiated with the ultraviolet ray before and after the recording medium passes across the ultraviolet ray irradiated by the irradiating unit.

(4) The ink-jet recording device as described in the item (1) or (2), which comprises: a reflective plate that is disposed on a line in an irradiating direction of the ultraviolet ray toward the recording medium and on a side of the recording medium opposite the irradiating unit, and reflects the ultraviolet ray irradiated from the irradiating unit toward the filter unit, wherein the filter unit is disposed in the vicinity of an outlet of the recording medium, the outlet being provided the ink-jet recording device, and the reflective plate reflects the ultraviolet ray so as to irradiate the filter unit with the ultraviolet ray before and after the recording medium passes across the ultraviolet ray irradiated by the irradiating unit.

(5) The ink-jet recording device as described in the item (4), which comprises: a suction fan that is provided in the vicinity of the outlet of the recording medium.

(6) The ink-jet recording device as described in the item (4), which comprises: a suction fan that is provided in the vicinity of the ink-jet head, wherein the suction fan that flows air taken in the ink-jet recording device toward the recording medium in an ejection direction of the ink so as to surround the ink-jet head.

As mentioned above, in accordance with the invention, a filter unit which is activated when irradiated with ultraviolet ray irradiated by an irradiating unit is provided, making it possible to obtain a ink-jet recording device which can form a high quality image at an excellent productivity without generating volatile components.

JP-A-2005-70264 discloses an image forming device which uses a filter unit to remove odor from the interior thereof. To this end, a dedicated illuminating light is needed, adding to cost. Further, the installation space for the illuminating light is needed.

Referring to how the illuminating light is used, the illuminating light is operated in ON/OFF control mode, i.e., ON for a predetermined period of time, OFF, and ON again. The in-rush current developed when the illuminating light is switched ON gives a great burden on the illuminating light. Therefore, the illuminating light has a shorter life when switched ON/OFF repeatedly than when kept ON. Thus, this ON/OFF control mode is not desirable.

In accordance with the invention, it is not necessary that a dedicated illuminating light be separately provided. Further, ON/OFF control mode, in which the life of the illuminating light is drastically reduced, is not used. Moreover, an illuminating light which is kept ON can be operated at as high an efficiency as 100% such that emission cannot be wasted.

BRIEF DESCRIPTION OF THE DRAWINGS

The invention disclosed herein will be understood better with reference to the following drawings of which:

FIG. 1 is a schematic drawing that illustrates configuration of an ink-jet recording device according to Embodiment 1 of the invention wherein

FIG. 2 is a schematic drawing that illustrates configuration of an ink-jet recording device according to Embodiment 2 of the invention wherein

FIG. 3 is a schematic drawing that illustrates configuration an ink-jet recording device according to Embodiment 3 of the invention wherein

FIG. 4 is a schematic drawing that illustrates configuration of an ink-jet recording device according to Embodiment 4 of the invention wherein

DETAILED DESCRIPTION OF THE INVENTION

Exemplary embodiments of the invention will be hereunder described in reference to the attached drawings.

Embodiment 1

Figure 1A:
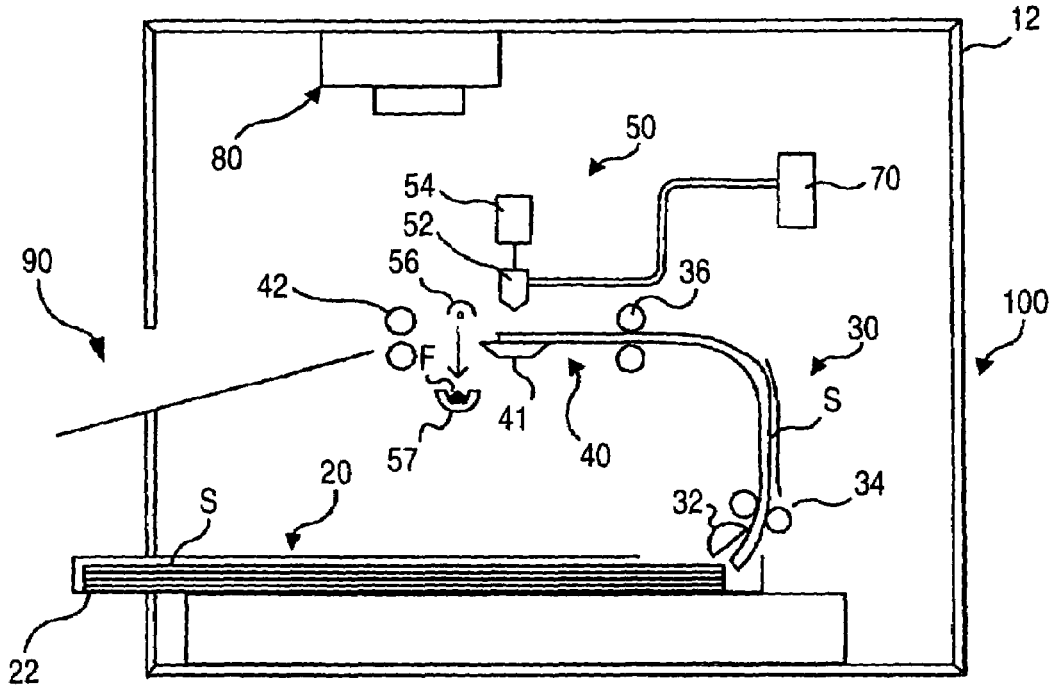
FIG. 1A depicts an inventive mode and FIG. 1B depicts a fixing mode by irradiation with ultraviolet ray.
Figure 1B:
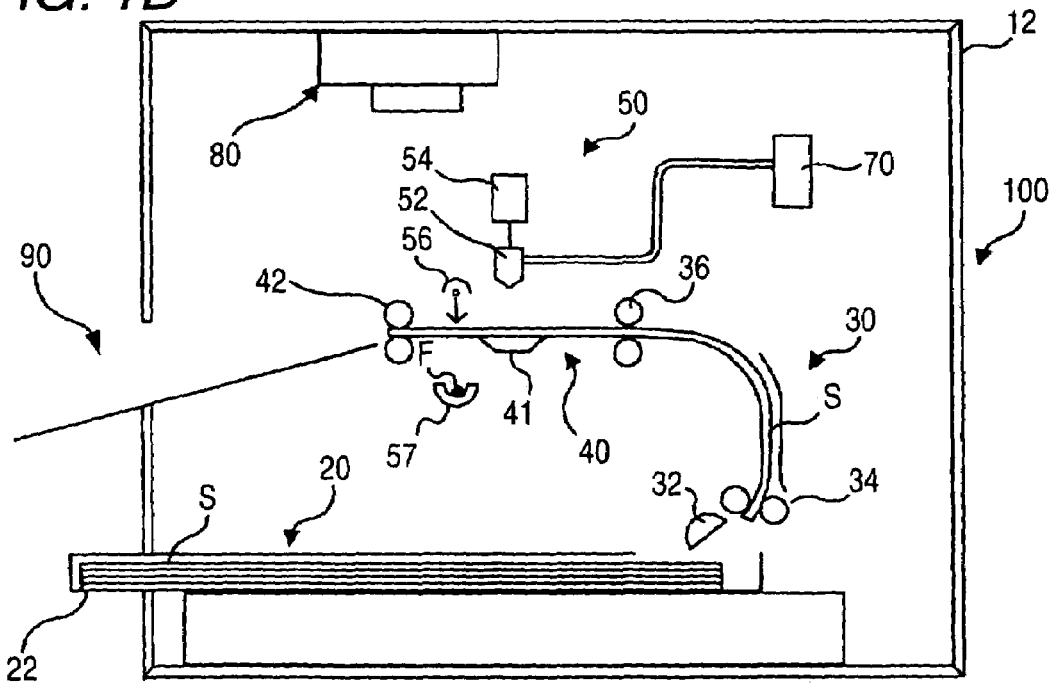

FIG. 1 is a schematic drawing that illustrates configuration of an ink-jet recording device of a roller conveying type according to Embodiment 1 of the invention. FIG. 1A is a drawing that illustrates how a filter unit provided according to the invention is irradiated with ultraviolet ray from an irradiating unit. FIG. 1B is a drawing that illustrates the operation of the conventional movement irradiating a recording medium with ultraviolet ray from an irradiating unit.

In these figures, the reference numeral 100 indicates a ink-jet recording device. The ink-jet recording device 100 comprises a housing 12 in which there are provided a recording medium housing portion 20 (hereinafter also simply referred to as "housing portion") for housing sheet-like recording media S having the same size in a stack, a conveying unit (hereinafter also referred to as "conveying portion") 30 for retrieving the recording medium S from the housing portion 20, a conveying and supporting portion 40 serving as a conveying unit for conveying the recording medium S conveyed by the conveying portion 30 while being supported within a recording position range, an image recording portion 50 for performing ink-jet image recording and ultraviolet fixing on the recording medium S which is being moved and scanned while being retained in the conveying and supporting portion 40 and a tray 90 onto which the recording medium S which has an image recorded thereon in the image recording portion 50 is outputted.

In the recording medium housing portion 20, a housing cassette 22 for housing the recording medium S is detachably disposed under the housing 12 of the ink-jet recording device 100 so that recording media S having different sizes replaced by each other can be supplied into the device. The recording medium housing portion 20 can also be arranged to have a plurality of cassettes mounted thereon.

In the conveying portion 30, a feed roller 32 is provided in contact with the forward end of the recording medium S in the housing cassette 22 set in the housing 12 in the insert direction of the housing cassette 22. Further, a pair of conveying rollers 34, 36 for conveying the recording medium S drawn out by the feed roller 32 to the conveying and supporting portion 40 is provided.

The conveying and supporting portion 40 has a flat platen 41 for supporting the recording medium S on the non-recording surface thereof opposite the recording surface thereof. Conveying rollers 36, 42 are provided before and after the platen 41, respectively. These conveying rollers are rotated in the predetermined direction on their axis, respectively. As the conveying rollers 36, 42 rotate, the recording medium S is conveyed from the conveying roller 36 to the conveying roller 42.

In the image recording portion 50 is provided an ink-jet head (hereinafter also referred to as "head unit") 52 including plural ejection nozzles extending toward the recording medium S arranged in the direction perpendicular to the surface of the drawing. The head unit 52 ejects an ink image-wise from the various ink ejection portions on the recording medium S at predetermined positions. In FIG. 1A, only a head unit 52 of a full line-head type for black K is illustrated. In the case of color mode, head units dedicated respectively for yellow Y, magenta M and cyan C are arranged parallel to the head unit 52 for black K upstream or downstream in the conveying direction.

To each of the various head units 52 is connected a head driver 54 which controls the amount of the ink to be ejected through the various ink ejection nozzles. To each of these head units 52 is connected a supplying portion 70 which supplies the respective ink.

An irradiating portion (hereinafter also referred to as "ultraviolet ray irradiating portion") 56 is disposed down the head unit 52 shortly after the image recording position. The ultraviolet ray irradiating portion 56 is adapted to irradiate the ink dropped on the recording medium S with ultraviolet ray so that the ink is immediately cured. As the light source for emitting ultraviolet ray there may be used high pressure mercury vapor lamp, black light fluorescent tube, low pressure mercury vapor lamp, ultraviolet ray emitting diode, ultraviolet semiconductor laser, excimer laser, Ti sapphire laser or the like.

The tray 90 receives sequentially sheets of recording media S driven by the conveying roller 42 to form a stack of recording media S. The tray 90 is disposed in such an arrangement that the forward end thereof (upstream side of the recording medium P in the conveying direction) is disposed outside the housing 12 and the rear end thereof is disposed inside the housing 12. The tray 90 is also tilted at a predetermined angle such that the forward end thereof is lower than the rear end thereof.

In order to inhibit the rise of temperature in the housing 12 due to the irritating light used in the curing of the ink in the ultraviolet ray irradiating portion 56, a ventilation cooling portion 80 is provided at the upper portion in the housing 12. The internal air is exhausted out of the device through the ventilation cooling portion 80.

The device described above is characterized in that the filter unit 57 which is activated when irradiated with ultraviolet ray irradiated by the ultraviolet ray irradiating portion 56 is provided according to the invention. The filter unit 57 is disposed on the side of the recording medium S opposite the emitting unit 57 at a position such that when the ultraviolet ray irradiated by the ultraviolet ray irradiating portion 56 are not blocked by the recording medium S, the filter unit 57 is irradiated with the irritating light.

The filter unit 57 is formed by a porous ceramic having a void of 50% or more and a pore diameter of from 10 μm to 100 μm and has a photocatalyst dispersed and supported therein. As the photocatalyst there is effectively used titanium oxide.

In the case where the filter unit 57 comprising a photocatalyst incorporated therein has odor component-containing air present therein, when the filter unit 57 is irradiated with ultraviolet ray having a wavelength of from 300 nm to 400 nm irradiated by the ultraviolet ray irritating portion 56, organic components which are odor components are decomposed to eliminate odor, giving no unpleasant feeling.

The operation of the device will be described hereinafter.

During the operation of the device, the ultraviolet ray irradiating portion 56 keeps irritating ultraviolet ray.

As illustrated in FIG. 1B, the recording medium S on which the ink has been dropped in the image recording portion 50 is then irradiated with ultraviolet ray irradiated by the ultraviolet ray irradiating portion 56 while passing under the ultraviolet ray irradiating portion 56 so that the ink is cured and fixed. When the forward end of the recording medium S having an ink fixed thereon ha reached the tray 90 and the rear end of the recording medium S has passed under the ultraviolet ray irradiating portion 56, ultraviolet ray irradiated by the ultraviolet ray irradiating portion 56 are no longer blocked by the recording medium S to cause the filter unit 57 to be automatically irradiated with ultraviolet ray as illustrated in FIG. 1A. When the filter unit 57 is irradiated with ultraviolet ray, the organic compounds constituting foreign matters F caught by the filter unit 57 are then decomposed to eliminate odor.

When the subsequent recording medium S has reached the position under the ultraviolet ray irradiating portion 56, the irradiation of the filter unit 57 is then suspended and followed by the ordinary fixing operation involving the fixation of ink on the recording medium S.

Thus, the provision of the filter unit 57 which is activated when irradiated with ultraviolet ray causes the elimination of odor of ink, making it possible to prevent the user from being offended by unpleasant odor.

Further, the invention is also characterized in that as the device for irradiating the filter unit 57 with ultraviolet ray, the ultraviolet ray irradiating portion 56 for curing the ink on the recording medium S is also used effectively while the ink is not being cured instead of separately providing an ultraviolet lamp.

In other words, during the passage of the recording medium S under the ultraviolet ray irradiating portion 56, the ink on the recording medium S is cured as illustrated in FIG. 1B. Even when the recording medium S is not present under the ultraviolet ray irradiating portion 56, the ultraviolet ray irradiating portion 56 remains the same in the direction of emission to irradiate the filter unit 57 with ultraviolet ray as illustrated in FIG. 1A. In this arrangement, the ultraviolet ray irradiating portion 56 can be operated as effectively as 100% without necessitating a complicated, expensive and fragile switching mechanism to remove odor.

Embodiment 2

Figure 2A:
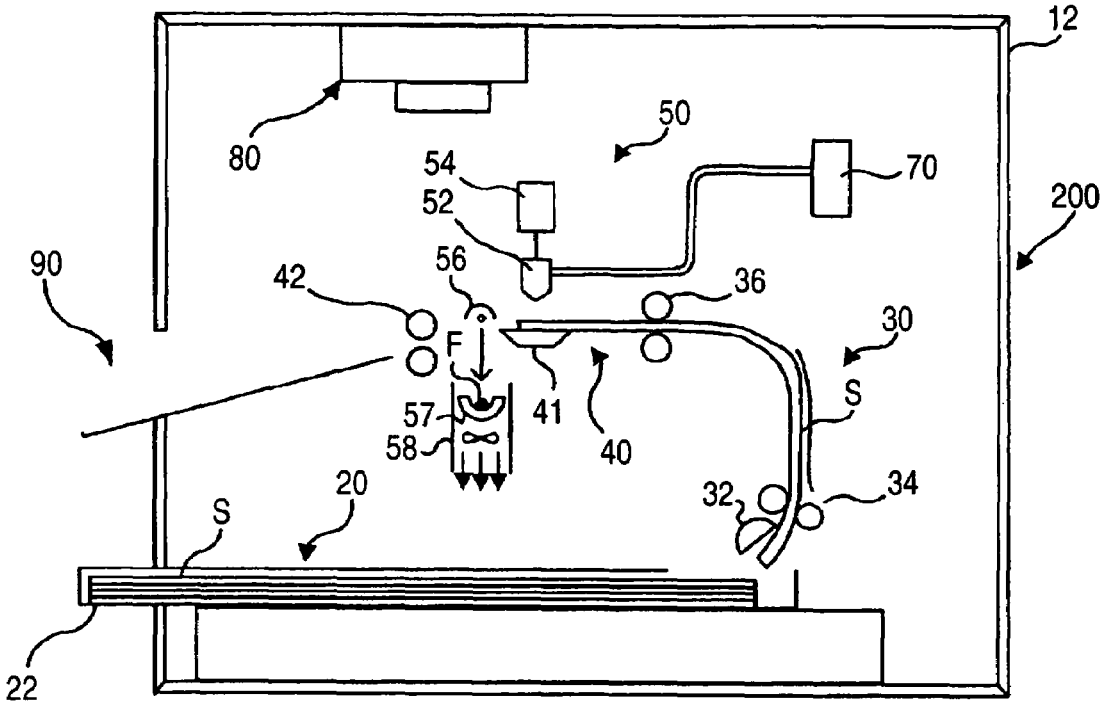
FIG. 2A depicts an inventive mode and FIG. 2B depicts a fixing mode by irradiation with ultraviolet ray.
Figure 2B:
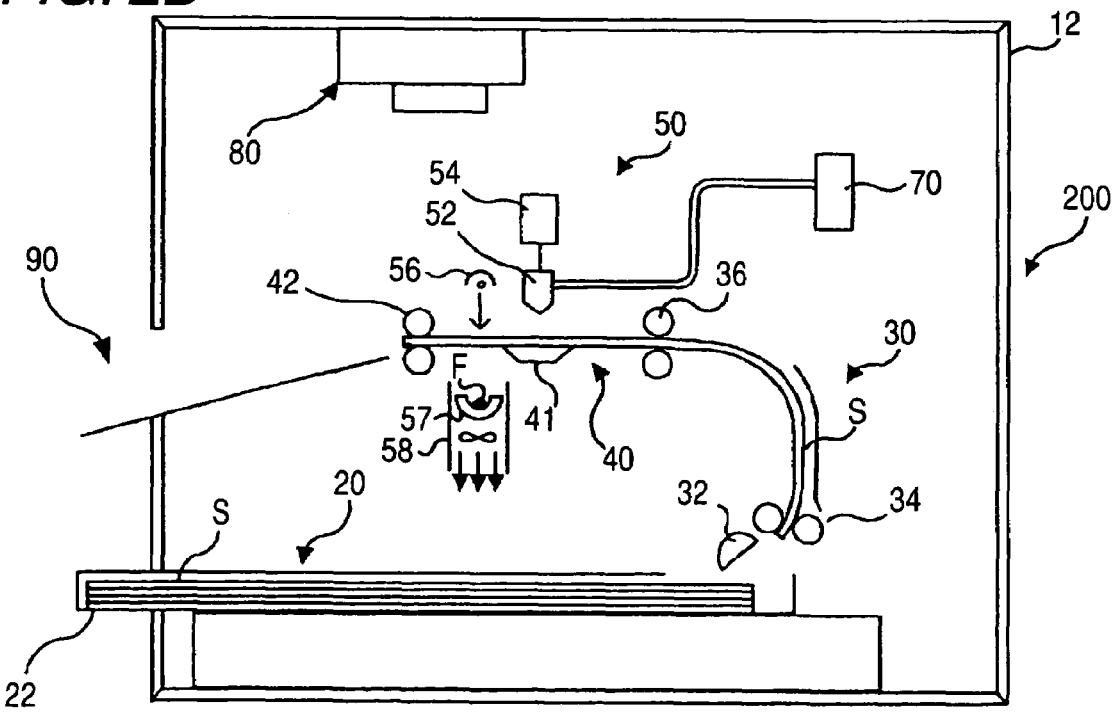

FIG. 2 is a schematic drawing that illustrates configuration of an ink-jet recording device of a roller conveying type according to Embodiment 2 of the invention. FIG. 2A is a drawing that illustrates how a filter unit provided according to the invention is irradiated with ultraviolet ray from an irritating unit. FIG. 2B is a diagram that illustrates the operation of the conventional photo setting technique involving the irradiation of a recording medium with ultraviolet ray from an irritating unit.

Embodiment 2 is characterized in that the device of Embodiment 1 is additionally provided with a unit for forming air flow toward the filter unit.

In these figures, the reference numeral 58 indicates an air flow forming unit as a suction fan comprising an aspiration fan and a duct surrounding the aspiration fan. The air flow forming unit 58 is disposed close to the filter unit 57 on the side thereof opposite the ultraviolet ray irradiating portion 56. When the aspiration fan rotates, an air flow is developed in the duct in the direction shown by the arrow so that the air flows mainly through this region to pass through the filter unit 57, causing the odor components F in the air in the device to be caught by the filter unit 57.

When the rear end of the recording medium S has passed under the ultraviolet ray irradiating portion 56 under these conditions, the mode is switched from the ink irradiation mode illustrated in FIG. 2B to the filter unit irradiation mode illustrated in FIG. 2A. Thus, the ultraviolet ray irradiated by the ultraviolet ray irradiating portion 56 then hit the filter unit instead of the recording medium S. The odor components F in the air caught by the filter unit 57 are then decomposed by ultraviolet ray to eliminate odor.

As mentioned above, in accordance with Embodiment 2, a unit for forming air flow toward the filter unit is added. In this arrangement, a circulation system allowing the flow of air toward the filter unit 57 in the device is formed, making it possible for the odor components F in the air to be caught efficiently by the filter unit 57.

Embodiment 3

Figure 3A:
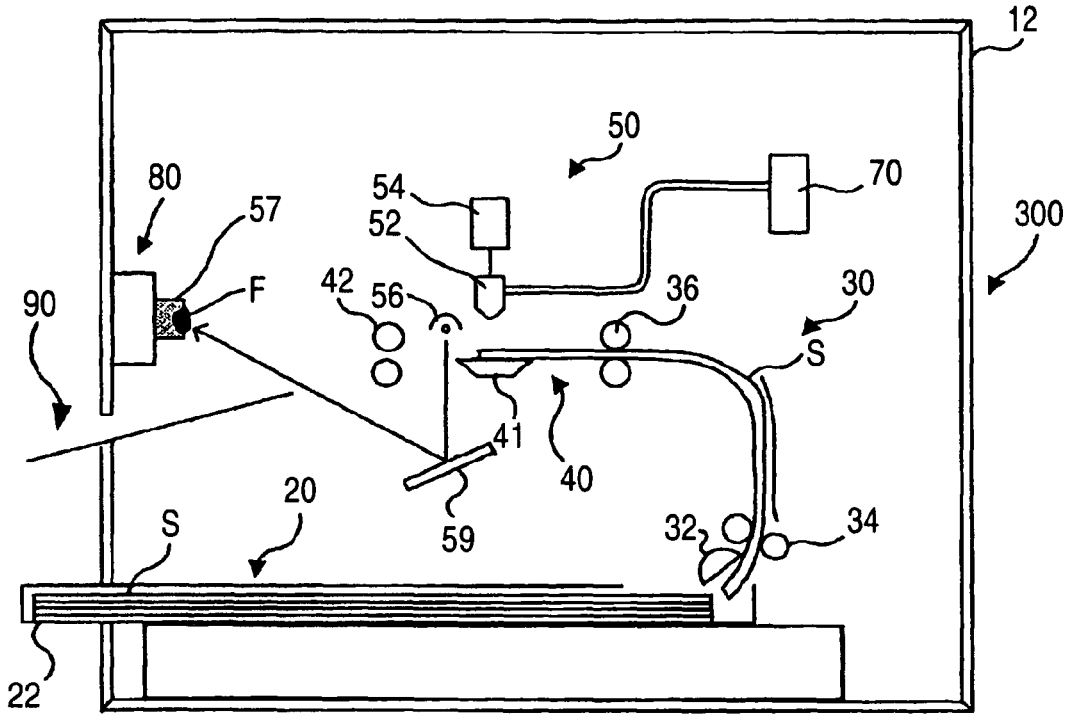
FIG. 3A depicts an inventive mode and FIG. 3B depicts a fixing mode by irradiation with ultraviolet ray.
Figure 3B:
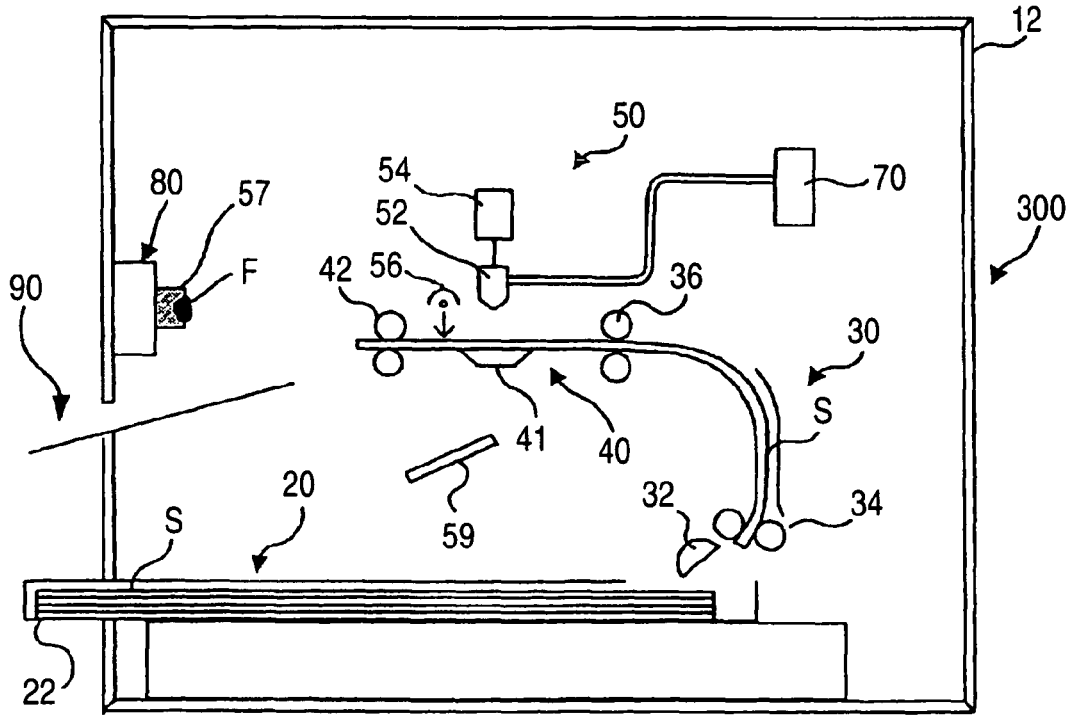

FIG. 3 is a schematic drawing that illustrated configuration of an ink-jet recording device according to Embodiment 3 of the invention. FIG. 3A is a drawing that illustrates how a filter unit provided according to the invention is irradiated with ultraviolet ray from an irritating unit. FIG. 3B is a drawing that illustrates the operation of the conventional photo setting technique involving the irradiation of a recording medium with ultraviolet ray from an irritating unit.

The ink-jet recording device according to Embodiment 3 is characterized in that the ventilation cooling portion 80 as the suction fan is provided in the vicinity of the tray 90, which is the outlet of the recording medium S, the filter unit 57 is provided in the air passage of the ventilation cooling portion 80 and the reflective plate 59 for reflecting the ultraviolet ray from the ultraviolet ray irradiating portion 56 toward the filter unit 57 is disposed on the extension line from the ultraviolet ray irradiating portion 56 toward the recording medium S on the side of the recording medium S opposite the irritating unit 56.

In these figures, when the ventilation cooling portion 80 operates, the inner air flows mainly toward the ventilation cooling portion 80 to pass through the filter unit 57 so that the odor components F in the air in the device are caught by the filter unit 57.

When the rear end of the recording medium S has passed under the ultraviolet ray irradiating portion 56 under these conditions, the mode is switched from the ink irradiation mode illustrated in FIG. 3B to the filter unit irradiation mode illustrated in FIG. 3A. Thus, the ultraviolet ray from the ultraviolet ray irradiating portion 56 is then reflected by the reflective plate 59 instead of hitting the recording medium S. The ultraviolet ray thus reflected then hit the filter unit 57. Thus, the odor components F in the air caught by the filter unit 57 are decomposed by the ultraviolet ray to eliminate odor.

In accordance with Embodiment 3, the ventilation cooling portion 80 is disposed in the vicinity of the outlet of the recording medium S. In this arrangement, the air flows toward the ventilation cooling portion 80 while cleaning the recording medium S to remove dust. The dust is then removed by the cleaning filter. The resulting purified air is then exhausted out of the device from the ventilation cooling portion 80.

The odor components F are caught by the filter unit 57. The ultraviolet ray irradiated by the ultraviolet ray irradiating portion 56 is reflected by the reflective plate 59 and then hit the filter unit 57 instead of hitting the recording medium S. In this manner, the odor components F in the air caught by the filter unit 57 are decomposed by the ultraviolet ray to eliminate odor.

Embodiment 4

Figure 4A:
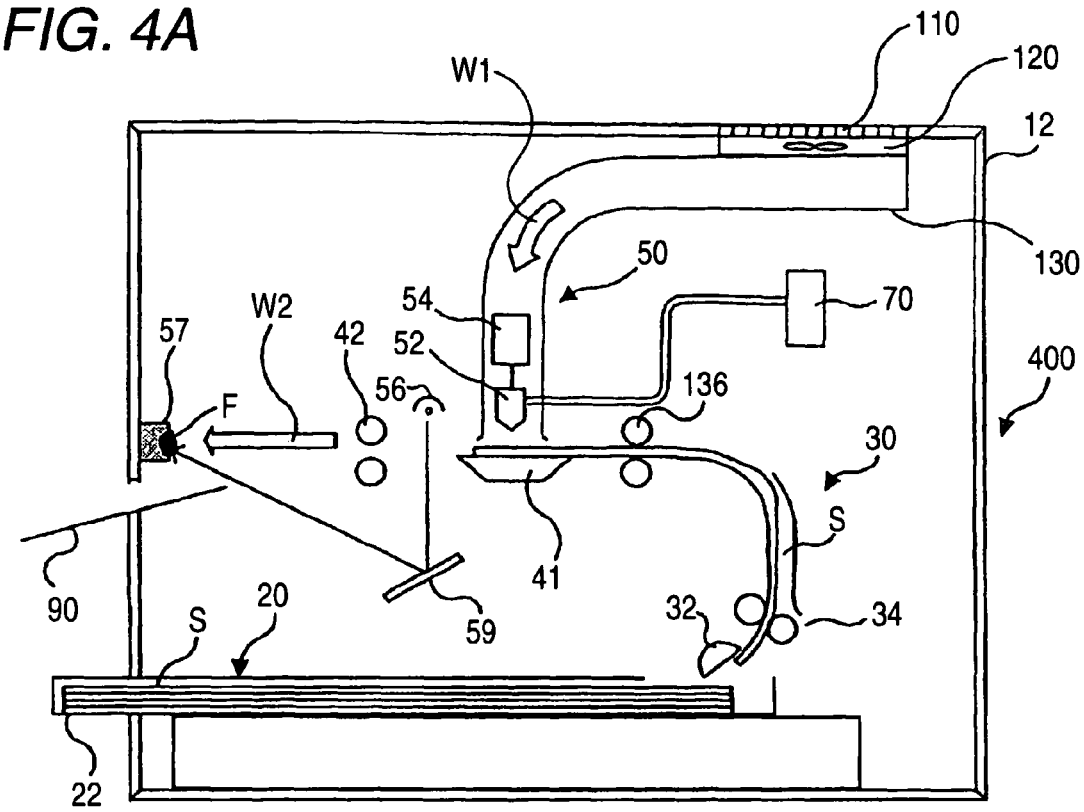
FIG. 4A depicts an inventive mode and FIG. 4B depicts a fixing mode by irradiation with ultraviolet ray.
Figure 4B:
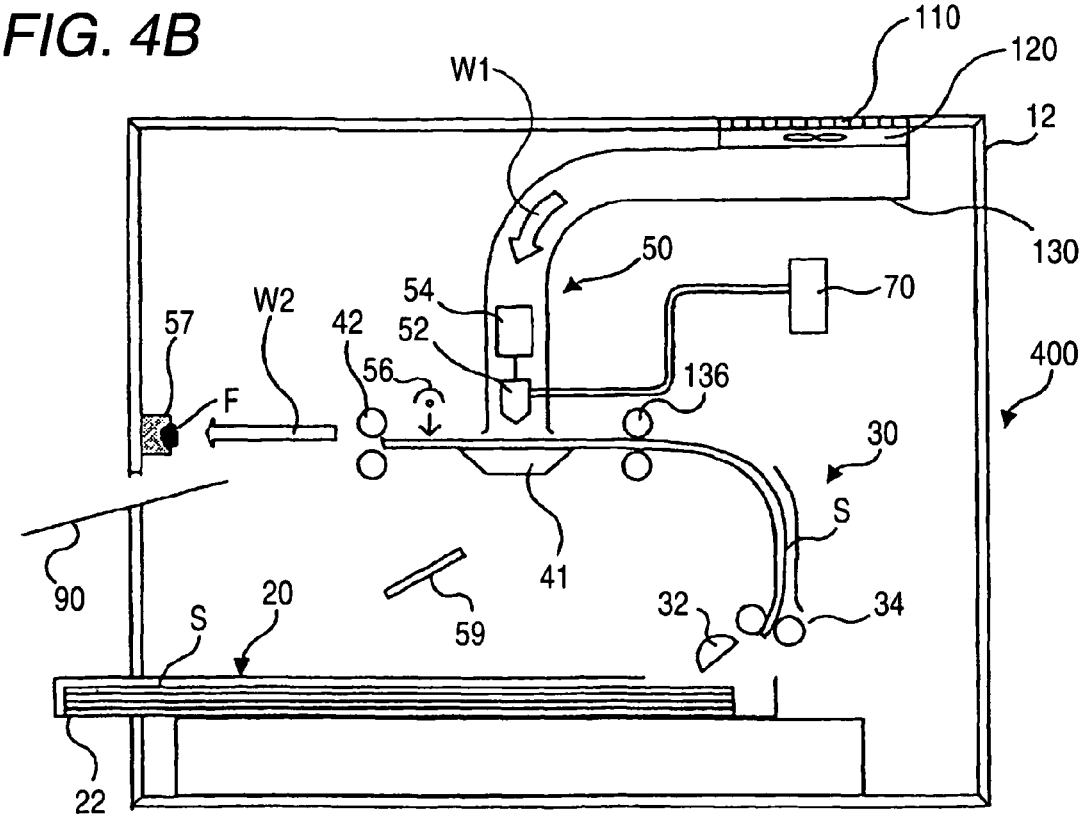
Figure 5:
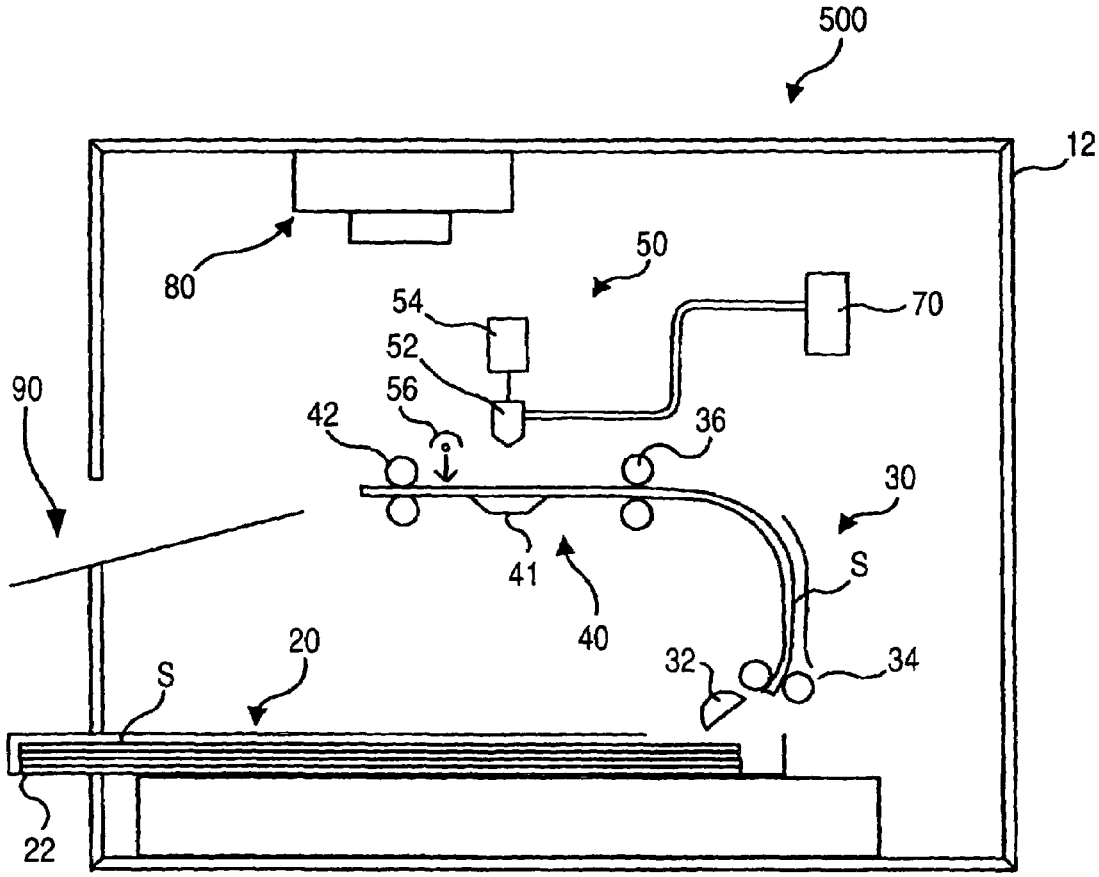
FIG. 5 is a schematic drawing that illustrates configuration of an ink-jet recording device of fixing mode according to the related art devices.

FIG. 4 is a schematic drawing that illustrates configuration of an ink-jet recording device according to Embodiment 4 of the invention. FIG. 4A is a drawing that illustrates how a filter unit provided according to the invention is irradiated with ultraviolet ray from an irritating unit. FIG. 4B is a drawing that illustrates the operation of the conventional photo setting technique involving the irradiation of a recording medium with ultraviolet ray from an irritating unit.

The ink-jet recording device according to Embodiment 4 is characterized in that pressure adjusting units 110 to 130 are provided instead of the ventilation cooling portion 80 of Examples 1 to 3. In these figures, the reference numeral 110 indicates a filter, the reference numeral 120 indicates an aspiration fan as a suction fan and the reference numeral 130 indicates a duct. The filter 110 is adapted to remove dust and foreign matters from the external air which is being taken in the device, providing clean air. The aspiration fan 120 is adapted to take the clean external air given by the filter 110 into the device. The duct 130 covers the exhaustion side of the aspiration fan 120 at one end thereof and the ink-jet head 52 at the other and extends to the forward end of the ink-jet head 52 at which it is opened toward the recording medium S. In this arrangement, the air flow which has been blocked by the recording medium S is then branched upstream and downstream in the conveying direction. The downstream air flow W2 proceeds to the outlet. The filter unit 57 according to the invention is provided at the position where the air flow W2 collides with the filter unit 57. The reflective plate 59 for reflecting the ultraviolet ray from the ultraviolet ray irradiating portion 56 toward the filter unit 57 is provided on the extension line from the ultraviolet ray irradiating portion 56 toward the recording medium S on the side of the recording medium S opposite the irritating unit 56.

The function of these pressure adjusting units 110 to 130 will be described hereinafter.

When the aspiration fan 120 operates, the external air containing dust is cleaned through the filter 110, and then taken into the device. The clean air thus taken passes through the duct 130 to the ink-jet head 52 from which it is then exhausted toward the recording medium S. The air then flows along the surface of the recording medium S toward the outlet where the tray 90 is disposed to form an air flow W2 which then hits the filter unit 57. In this manner, the odor components F in the air flow in the device are caught by the filter unit 57. When the mode is switched from the ink irradiation mode illustrated in FIG. 4B to the filter unit irradiation mode illustrated in FIG. 4A, the ultraviolet ray from the ultraviolet ray irradiating portion 56 are then reflected by the reflective plate 59 to hit the filter unit 57. In this manner, the odor components F in the air caught by the filter unit 57 are decomposed by the ultraviolet ray to eliminate odor.

The air flow W2 removes dust from the surface of the recording medium S, making it possible to effect clean image processing free from stain.

As mentioned above, in accordance with Embodiment 4, the air which has been cleaned and given a higher pressure than the external air by the pressure adjusting units 110 to 130 flows through the duct 130 and then around the ink-jet head 52 to form an air curtain around the ink-jet head 52 so that foreign matters such as dust and paper dust, if any in the device, cannot approach the nozzle of the ink-jet head, making it possible to keep the ink-jet head 52 clean.

Further, when the clean air flows along the surface of the recording medium S, dust and other foreign matters are blown from the recording medium S, making it possible to effect fixing with the surface of the recording medium S kept clean.

Moreover, since the interior of the device is always kept under a high pressure, the air is exhausted out of the device through the outlet of the tray 90 to discharge the foreign matters out of the device. At the same time, the air taken into the device is cleaned by the filter 110. Thus, in the final stationary state, the interior of the device can be kept clean. During this procedure, the air flow-containing the odor components F in the air in the device is caught by the filter unit 57 which is irradiated with the ultraviolet ray from the ultraviolet ray irradiating portion 56 which are reflected by the reflective plate 59 instead of hitting the recording medium S. Thus, the odor components F in the air caught by the filter unit 57 are decomposed by the ultraviolet ray to eliminate odor.

As mentioned above, in accordance with the invention, a filter unit which is activated when irradiated with ultraviolet ray from an irritating unit is provided, making it possible to obtain an ink-jet recording device which can draw a high quality image at an excellent productivity without generating volatile components.

As compared with the image forming device disclosed in JP-A-2005-70264, the device according to the invention requires no dedicated illuminating light, making it possible to reduce cost and installation space.

While the aforementioned example has been described with reference to the case where as the head there is used an ink head of the full-line head type, the invention can be effectively applied also to the system using an ink head of a serial scanning type.

The cationic polymer-based ink compositions, radical polymerization-based ink compositions and aqueous ink compositions which can be used in the invention will be further described hereinafter.

(Cationic Polymer-based Ink Composition)

The cationic polymer-based ink composition comprises (a) a cationically polymerizable compound and (b) a compound which generates an acid when irradiated with light energy. The cationic polymer-based ink composition may optionally further comprise (d) an organic acidic component having a pKa value of from 2 to 6, (e) a colorant, etc.

The various components constituting the cationic polymer-based compound will be sequentially described hereinafter.

((a) Cationically Polymerizable Compound)

The cationically polymerizable compound (a) to be used in the invention is not specifically limited so far as it is a compound which undergoes polymerization reaction with the acid generated by the compound (b) described later which generates an acid when irradiated with light energy to cause curing. As such a compound there may be used any of various cationically polymerizable monomers known as cationic photopolymerizable monomer. Examples of the cationically polymerizable monomers include epoxy compounds, vinylether compounds and oxetane compounds disclosed in JP-A-6-9714, JP-A-2001-31892, JP-A-2001-40068, JP-A-2001-55507, JP-A-2001-310938, JP-A-2001-310937, and JP-A-2001-220526.

Examples of the epoxy compounds include aromatic epoxides, and alicyclic epoxides.

As the aromatic epoxide there may be used a di- or polyglycidylether produced by the reaction of a polyvalent phenol having at least one aromatic nucleus or alkylene oxide adduct thereof with epichlorohydrin. Examples of the di- or polyglycidylether include di- or polyglycidylether of bisphenol A or alkylene oxide adduct thereof, di- or polyglycidylether of hydrogenated bisphenol A or alkylene oxide adduct thereof, and novolac type epoxy resin. Examples of the alkylene oxide include ethylene oxide, and propylene oxide.

As the alicyclic epoxide there is preferably used a cyclohexene oxide- or cyclopentene oxide-containing compound obtained by epoxidizing a compound having at least one cycloalkane ring such as cyclohexene and cyclopentene ring with a proper oxidizing agent such as hydrogen peroxide and peracid.

As the aliphatic epoxide there may be used a di- or polyglycidylether of aliphatic polyvalent alcohol or alkylene oxide adduct thereof. Representative examples of the di- or polyglycidylether include diglycidylethers of alkylene glycol such as diglycidylether of ethylene glycol, diglycidylether of propylene glycol and diglycidylether of 1,6-hexanediol, polyglycidylethers of polyvalent alcohol such as di- or triglycyiylether of glycerin or alkylene oxide adduct thereof, and diglycidylethers of polyalkylene glycol such as diglycidylether of polyethylene glycol or alkylene oxide adduct thereof and diglycidylether of polypropylene glycol or alkylene oxide adduct thereof. Examples of the alkylene oxide include ethylene oxide and propylene oxide.

The epoxy compound may be monofunctional or polyfunctional.

Examples of the monofunctional epoxy compound employable herein include phenylglycidylether, p-tert-butylphenyl glycidylether, butyl glycidylether, 2-ethylhexyl glycidylether, allyl glycidylether, 1,2-butylene oxide, 1,3-butadiene monoxide, 1,2-epoxy dodecane, epichlorohydrin, 1,2-epoxydecane, styrene oxide, cyclohexene oxide, 3-methacryloyloxymethyl cyclohexene oxide, 3-acryloyloxy methyl cyclohexene oxide, and 3-binyl cyclohexene oxide.

Examples of the polyfunctional epoxy compound include bisphenol A diglycidylether, bisphenol F diglycidylether, bisphenol S diglycidylether, bromated bisphenol A diglycidylether, bromated bisphenol F diglycidylether, bromated bisphenol S diglycidylether, epoxy novolac resin, hydrogenated bisphenol A diglycidylether, hydrogenated bisphenol F diglycidylether, hydrogenated bisphenol S diglycidylether, 3,4-epoxycyclohexylmethyl-3',4'-epoxycyclohexane carboxylate, 2-(3,4-epoxycyclohexyl-5,5-spiro-3,4-epoxy)cyclohexane-metha-dioxane, bis(3,4-epoxycyclohexylmethyl) adipate, vinylcyclohexene oxide, 4-vinylepoxycyclohexane, bis(3,4-epoxy-6-methylcyclohexyl)adipate, 3,4-epoxy-6-methylcyclohexyl -3',4'-epoxy-6'-methylcyclohexane carboxylate, methylene bis(3,4-epoxycyclohexane), dicyclopentadiene epoxide, di(3,4-epoxycyclohexyl methyl)ether of ethylene glycol, ethylene bis(3,4-epoxy cyclohexanecarboxylate), dioctyl epoxy hexahydrophthalate, di-2-ethylhexyl epoxy hexahydrophthalate, 1,4-butanediol diglycidylether, 1,6-hexanediol diglycidylether, glycerin triglycidylether, trimethylolpropane triglycidylether, polyethylene glycol diglycidylether, polypropylene glycol diglycidylether, 1,1,3-tetradecadiene dioxide, limonene dioxide, 1,2,7,8-diepoxyoctane, and 1,2,5,6-diepoxycyclooctane.

Preferred among these epoxy compounds are aromatic epoxides and alicyclic epoxides because they can be cured very quickly. Particularly preferred among these epoxy compounds are alicyclic epoxides.

Examples of the vinylether compound employable herein include di- or trivinylether compounds such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether and trimethylolpropane trivinyl ether, and monovinyl ether compounds such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexane dimethanol monovinyl ether, n-propylvinyl ether, isopropylvinyl ether, isopropenyl ether-O-propylene carbonate, dodecylvinyl ether, diethylene glycol monovinyl ether and octadecylvinyl ether.

The vinylether compound of the invention may be monofunctional or polyfunctional.

Specific examples of the monofunctional vinylether include methyl vinyl ether, ethyl vinyl ether, propyl vinyl ether, n-butyl vinyl ether, t-butyl vinyl ether, 2-ethylhexyl vinyl ether, n-nonyl vinyl ether, lauryl vinyl ether, cyclohexyl vinyl ether, cyclohexyl methyl vinyl ether, 4-methylcyclohexyl methyl vinyl ether, benzyl vinyl ether, dicyclopentenyl vinyl ether, 2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxy polyethylene glycol vinyl ether, tetrahydrofuryl vinyl ether, 2-hydroxyethyl vinyl ether, 2-hydroxypropyl vinyl ether, 4-hydroxybutyl vinyl ether, 4-hydroxymethyl cyclohexyl methyl vinyl ether, diethylene glycol monovinyl ether, polyethylene glycol vinyl ether, chloroethyl vinyl ether, chlorobutyl vinyl ether, chloroethoxyethyl vinyl ether, phenylethyl vinyl ether, and phenoxy polyethylene glycol vinyl ether.

Examples of the polyfunctional vinyl ether include vinyl ethers such as ethylene glycol divinyl ether, diethylene glycol divinyl ether, polyethylene glycol vinyl ether, propylene glycol divinyl ether, butylene glycol divinyl ether, hexanediol divinyl ether, bisphenol A alkylene oxide divinyl ether and bisphenol F alkylene oxide divinyl ether, and polyfunctional vinyl ethers such as trimethylolethane trivinyl ether, trimethylolpropane trivinyl ether, ditrimethylolpropane tetravinyl ether, glycerin trivinyl ether, pentaerythritol tetravinyl ether, dipentaerythritol pentavinyl ether, dipentaerythtritol hexavinyl ether, ethylene oxide-added trimethylolpropane trivinyl ether, propylene oxide-added trimethylolpropane trivinyl ether, ethylene oxide-added ditrimethylolpropane tetravinyl ether, propylene oxide-added ditrimethylol propane tetravinyl ether, ethylene oxide-added pentaerythritol tetravinyl ether, propylene oxide-added pentaerythritol tetravinyl ether, ethylene oxide-added dipentaerythritol hexavinyl ether, and propylene oxide-added dipentaerythritol hexavinyl ether.

Preferred among these vinylether compounds are di- or trivinylether compounds from the standpoint of curability, adhesion to recording medium and surface hardness of image thus formed. Particularly preferred among these vinylether compounds are divinylether compounds.

The oxetane compound of the invention is a compound having an oxetane ring. Known oxetane compounds as disclosed in JP-A-2001-220526, JP-A-2001-310937 and JP-A-2003-341217 can be arbitrarily selected.

As the compound having an oxetane ring which can be used in the ink composition of the invention there is preferably used a compound having from 1 to 4 oxetane rings. The use of such a compound makes it easy to keep the viscosity of the ink composition within a range such that the ink composition can be fairly handled and makes it possible to obtain a high adhesion between the ink composition thus cured and the recording medium.

For the details of the compound having an oxetane ring, reference can be made to the above cited JP-A-2003-341217, paragraph [0021] to [0084]. The compounds disclosed in the above cited patent can be used also in the invention to advantage.

Preferred among the oxetane compounds to be used in the invention are those having one oxetane ring from the standpoint of viscosity and adhesion of ink composition.

The ink composition of the invention may comprise these cationically polymerizable compounds incorporated therein singly or in combination of two or more thereof. From the standpoint of effectiveness in the inhibition of shrinkage during ink curing, however, at least one compound selected from the group consisting of oxetane compounds and epoxy compounds and vinylether compounds are preferably used in combination.

The content of the cationically polymerizable compound (a) in the ink composition is preferably from 10% to 95% by weight, more preferably from 30% to 90% by weight, even more preferably from 50% to 85% by weight based on the total solid content of the composition.

((b) Compound which Generates an Acid when Irradiated with Light Energy)

The ink composition of the invention contains a compound which generates an acid when irradiated with light energy (hereinafter optionally referred to as "photoacid generator").

As the photoacid generator to be used in the invention there may be properly selected cationic photopolymerization initiator, photoradical polymerization initiator, photodiscoloring agent for dyes, photodecoloring agent, or a compound which generates when irradiated with irritating light used for microresist (ultraviolet ray having a wavelength of from 200 nm to 400 nm, far ultraviolet ray, particularly preferably g-beam, h-beam, i-beam, KrF excimer laser beam), ArF excimer laser beam or the like.

Examples of the photoacid generator include onium salts such as diazonium salt, ammonium salt, phosphonium salt, iodonium salt, sulfonium salt, selenonium salt and arsonium salt, organic halogen compounds and organic metal/organic halogen compounds which undergo decomposition and generate an acid when irradiated with light energy, photoacid generators having o-nitrobenzyl type protective group, compounds which undergo photodecomposition to sulfonic acid such as iminosulfonate, disulfone compounds, diazoketosulfone, and diazodisulfone compounds.

As the photoacid generator there is preferably used also a oxazole derivative or s-triazine derivative disclosed in JP-A-2002-122994, paragraph [0029] to [0030]. Further, onium salt compounds and sulfonate-based compounds exemplified in JP-A-2002-122994, paragraph [0037] to [0063] can be used as photoacid generator in the invention to advantage.

These photoacid generators (b) may be used singly or in combination of two or more thereof.

The content of the photoacid generator (b) in the ink composition is preferably from 0.1 to 20% byweight, more preferably from 0.5 to 10% by weight, even more preferably from 1 to 7% by weight based on the total solid content of the ink composition.

The ink composition of the invention may also comprise various additives incorporated therein in addition to the aforementioned essential components. These arbitrary components will be further described hereinafter.

((d) Organic Acidic Component having a pKa Value of from 2 to 6)

The ink composition of the invention may comprise (d) an organic acidic component having a pKa value of from 2 to 6 (hereinafter occasionally referred simply to as "organic acidic component") incorporated therein. The organic acidic component having a pKa value of from 2 to 6 (d) corresponds qualitatively to a weakly acidic organic compound. The organic acidic component having a pKa value of more than 6 causes the drop of sensitivity when incorporated in the ink composition of the invention. The organic acidic component having a pKa value of less than 2 causes the deterioration of age stability of the ink composition. Thus, in the invention, an organic acidic component having pKa value of from 2 to 6 is preferably used.

Specific examples of the organic acidic component having a pKa value of from 2 to 6 include carboxylic acids. Examples of the carboxylic acid include $C_1$-$C_{20}$ aliphatic or aromatic monocarboxylic acids, dicarboxylic acids and tricarboxylic acids such as acetic acid, phenylacetic acid, phenoxyacetic acid, methoxypropionic acid, lactic acid, hexanoic acid, heptanoic acid, octanoic acid, palmitic acid, stearic acid, oleic acid, linoleic acid, cyclopropylcarboxylic acid, cyclobutanecarboxylic acid, cyclopentaneearboxylic acid, cyclohexanecarboxylic acid, 1-adamanthanecarboxylic acid, 1,3-adamanthane dicarboxylic acid, norbornene-2,3-dicarboxylic acid, abietic acid, trans-retinic acid, cyclohexylacetic acid, dicyclohexylacetic acid, adamanthaneacetic acid, malonic acid, monomethylester malonate, fumaric acid, maleic acid, monomethyl ester maleate, itaconic acid, crotonic acid, succinic acid, adipic acid, sebasic acid, glycolic acid, diglycolic acid, mandelic acid, tartaric acid, malic acid, alginic acid, cinnamic acid, methoxycinnamic acid, 3,5-dimethoxycinnamic acid, benzoic acid, salicylic acid, 4-hydroxybenzoic acid, gallic acid, 3-nitrobenzoic acid, 3-chlorobenzoic acid, 4-vinylbenzoic acid, t-butylbenzoic acid, 1-naphthoic acid, 1-hydroxy-2-naphtoic acid, fluorenone-2-carboxylic acid, 9-anthracene carboxylic acid, 2-anthraquinonecarboxylic acid, phthalic acid, monomethyl ester phthalate, isophthalic acid, terephthalic acid, trimellitic acid, and monomethyl ester trimellitate. However, the invention is not limited thereto.

((e) Coloring Agent)

The ink composition of the invention can form a visible image when it comprises a coloring agent incorporated therein.

The coloring agent to be used herein is not specifically limited. Any known coloring materials (pigment, dye) may be properly selected depending on the purpose. For example, in order to form an image excellent in weathering resistance, pigments are preferably used. As dyes there may be used any of water-soluble dyes and oil-soluble dyes. However, oil-soluble dyes are preferred.

Pigmenbs which are preferably used in the invention will be described hereinafter.

The pigments to be used in the invention are not specifically limited. A dispersion of any commercially available organic or inorganic pigment in a resin which cannot dissolve the pigment therein as a dispersion medium or a pigment the surface of which is grafted with a resin can be used. Alternatively, a particulate resin dyed with a dye can be used.

Examples of these pigments include those disclosed in Seishiro Ito, "Ganryo no Jiten (Dictionary of Pigments)", 2000, W. Herbst, K. Hunger, "Industrial Organic Pigments", JP-A-2002-12607, JP-A-2002-188025, JP-A-2003-26978, and JP-A-2003-342503.

Referring to specific examples of the organic pigments and inorganic pigments which can be used in the invention, examples of those which assume yellow color include monoazo pigments such as C. I. Pigment Yellow 1 (e.g., Fast Yellow G) and C. I. Pigment Yellow 74, disazo pigments such as C. I. Pigment Yellow 12 (e.g., Disazo Yellow AAA) and C. I. Pigment Yellow 17, non-benzidine-based azo pigments such as C. I. Pigment Yellow 180, azolake pigments such as C. I. Pigment Yellow 100 (e.g., Tartrazine Yellow Lake), condensed azo pigments such as C. I. Pigment Yellow 95 (e.g., condensed azo yellow GR), acidic dye lake pigments such as C. I. Pigment Yellow 115 (e.g., Quinoline Yellow Lake), basic dye lake pigments such as C. I. Pigment Yellow 18 (e.g., Thioflavin Lake), anthraquinone-based pigments such as Flavanthrone Yellow (Y-24), isoindolinone pigments such as Isoindolinone Yellow 3RLT (Y-110), quinophthalone pigments such as Quinophthalone Yellow (Y-138), Isoindoline pigments such as Isoindoline Yellow (Y-139), nitroso pigments such as C. I. Pigment Yellow 153 (e.g., Nickel Nitroso Yellow), and metal complex salt-based azomethine pigments such as C. I. Pigment Yellow 117 (e.g., copper azomethine yellow).

Examples of those which assume red or magenta color include monoazo-based pigments such as C. I. Pigment Red 3 (e.g., Toluidine Red), disazo pigments such as C. I. Pigment Red 38 (e.g., Pyrazolone Red B), azo lake pigments such as C. I. Pigment Red 53:1 (e.g., Lake Red C) and C. I. Pigment Red 57:1 (Brilliant Carmine 6B), condensed azo pigments such as C. I. Pigment Red 144 (e.g., Condensed Azo Red BR), acidic dye lake pigments such as C. I. Pigment Red 174 (e.g., Phloxine B Lake), basic dye lake pigments such as C. I. Pigment Red 81 (e.g., Rhodamine 6G' Lake), anthraquinone-based pigments such as C. I. Pigment Red 177 (e.g., Dianthraquinonyl Red), thioindigo pigments such as C. I. Pigment Red 88 (e.g., Thioindigo Bordeaux), perynone pigments such as C. I. Pigment Red 194 (e.g., Perynone Red), perylene pigments such as C. I. Pigment Red 149 (e.g., perylene Scarlet), quinacridone pigments such as C. I. Pigment Violet 19 (unsubstituted quinacridone) and C. I. Pigment Red 122 (e.g., Quinacridone Magenta), isoindolinone pigments such as C. I. Pigment Red 180 (e.g., Isoindolidone Red 2BLT) and alizarin lake pigments such as C. I. Pigment Red 83 (e.g., Madder Lake).

Examples of those which assume blue or cyan color include disazo-based pigments such as C. I. Pigment Blue 25 (e.g., Dianisidine Blue), phthalocyanine pigments such as C. I. Pigment Blue 15 (e.g., phthalocyanine blue), acidic dye lake pigments such as C. I. Pigment Blue 24 (e.g., Peacock Blue Lake), basic dye lake pigments such as C. I. Pigment Blue 1 (e.g., Bichlothia Pure Blue BO Lake), anthraquinone-based pigments such as C. I. Pigment Blue 60 (e.g., Indanthrone Blue), and alkali blue pigments such as C. I. Pigment Blue 18 (e.g., Alkali blue V-5:1).

Examples of those which assume green color include phthalocyanine pigments such as C. I. Pigment Green 7 (Phthalocyanine Green) and C. I. Pigment Green 36 (Phthalocyanine Green), and azo metal complex pigments such as C. I. Pigment Green 8 (Nitroso Green).

Examples of those which assume orange color include isoindoline-based pigments such as C. I. Pigment Orange 66 (Isoindoline Orange), and anthraquinone-based pigments such as C. I. Pigment Orange 51 (Dichloropyranthrone Orange).

Examples of those which assume black color include carbon black, titanium black, and aniline black.

Specific examples of the white pigments employable herein include basic lead carbonate ($2PbCO_3Pb(OH)_2$, i.e., so-called silver white), zincoxide (ZnO, i.e., so-called zinc white), titanium oxide ($TiO_2$, i.e., so-called titanium white), and strontium titanate ($SrTiO_3$, i.e., so-called titanium strontium white).

Among these white pigments, titanium oxide exhibits a small specific gravity, a great refractive index and a high chemical and physical stability as compared with the other white pigments and thus has a great opacifying strength and coloring power as a pigment. Titanium oxide is excellent also in durability against acid, alkali and other environmental factors. Accordingly, as white pigment there is preferably used titanium oxide. It goes without saying that other white pigments (which may be other than the above exemplified white pigments) may be used as necessary.

For the dispersion of pigment, a dispersing machine such as ball mill, sand mill, attritor, roll mill, jet mill, homogenizer, paint shaker, kneader, agitator, Henschel mixer, colloid mill, ultrasonic homogenizer, pearl mill and wet jet mill may be used.

The dispersion of pigment may be effected with a dispersant added. Examples of the dispersant employable herein include hydroxyl group-containing carboxylic acid esters, salts of long-chain polyamino amide with polymer acid ester, salts of high molecular polycarboxylic acid, high molecular unsaturated acid esters, high molecular copolymers, modified polyacrylates, aliphatic polyvalent carboxylic acids, naphthalenesulfonic acid-formalin condensates, polyoxyethylene alkylphosphoric acid esters, and pigment derivatives. Alternatively, commercially available dispersants such as Solspherse Series (produced by Zeneca Inc.) are preferably used.

As a dispersing aid there may be used a synergist depending on the pigment used. These dispersants and dispersing aids are preferably added in an amount of from 1 to 50 parts by weight based on 100 parts by weight of the pigment used.

As the dispersion medium for the various components such as pigment constituting the ink composition there may be used a solvent. Alternatively, the aforementioned cationically polymerizable compound (a), which is a low molecular component, may be used free of solvent. Since the ink composition of the invention is a radiation-curing ink which is adapted to be applied to the recording medium on which it is then cured, it is preferred that no solvents be used. This is because if any solvent remains in the cured ink image, the cured ink shows a deteriorated solvent resistance or the remaining solvent causes VOC (volatile organic compound) problem. From this standpoint of view, it is preferred that as the dispersion-medium there be used cationically polymerizable compound (a). Preferred among these cationically polymerizable compounds are those having the lowest viscosity from the standpoint of dispersibility or enhancement of handleability of ink composition.

The average particle diameter of the pigment is preferably from 0.02 μm to 4 μm, more preferably from 0.02 μm to 2 μm, even more preferably from 0.02 μm to 1.0 μm.

The kind of pigment, dispersant and dispersion medium to be used and the dispersion and filtration conditions are predetermined such that the average particle diameter of the pigment particles fall within the above defined desired range. By thus controlling the particle diameter, the clogging of the head nozzle can be inhibited, making it possible to maintain the desired ink storage stability, ink transparency and curing sensitivity.

(Dye)

The dye to be used in the invention is preferably oil-soluble. In some detail, the solubility of the dye of the invention in water at 25° C. (weight of dye to be dissolved in 100 g of water) is 1 g or less, preferably 0.5 g or less, more preferably 0.1 g or less. Accordingly, a so-called water-insoluble oil-soluble dye is preferably used.

Referring to the dye to be used in the invention, the aforementioned dye nucleus preferably has an oil-solubilizing group incorporated therein to cause the dye to be dissolved in the ink composition in a required amount.

Examples of the oil-solubilizing group include long-chain and branched alkyl groups, long-chain and branched alkoxy groups, long-chain and branched alkylthio groups, long-chain and branched alkylsulfonyl groups, long-chain and branched acyloxy groups, long-chain and branched alkoxycarbonyl groups, long-chain and branched acyl groups, long-chain and branched acylamino groups, long-chain and branched alkylsulfonylamino groups, long-chain and branched alkylaminosulfonyl groups, and aryl, aryloxy, aryloxycarbonyl, arylarbonyloxy, arylaminocarbonyl, arylaminosulfonyl and arylsulfonylamino groups containing these long-chain and branched substituents.

Alternatively, a water-soluble dye having a carboxylic acid or sulfonic acid maybe reacted with a long-chain or branched alcohol, amine, phenol or aniline derivative to convert the carboxylic acid or sulfonic acid into alkoxycarbonyl group, aryloxycarbonyl group, alkylaminosulfonyl group or arylaminosulfonyl group as an oil-solubilizing group, thereby providing a dye of the invention.

The aforementioned oil-soluble dye preferably has a melting point of 200° C. or less, more preferably 150° C. or less, even more preferably 100° C. or less. The use of an oil-soluble dye having a low melting point makes it possible to inhibit the crystallization of the dye in the ink composition and hence improve the storage stability of the ink composition.

In order to enhance the durability against fading, particularly against oxidizing materials such as ozone, and the curing properties, the oxidation potential of the oil-soluble dye is preferably positive (high). To this end, as the oil-soluble dye to be used in the invention there is preferably used one having an oxidation potential of 1.0 V (vsSCE) or more. The oxidation potential of the oil-soluble dye is preferably as high as possible, more preferably 1.1 V (vsSCE) or more, particularly preferably 1.15 V (vsSCE) or more.

As the yellow color dye there is preferably used a compound having the structure represented by the general formula (Y-I) disclosed in JP-A-2004-250483.

Particularly preferred examples of the yellow color dye include those represented by the general formulae (Y-II) to (Y-IV) disclosed in JP-A-2004-250483, paragraph [0034]. Specific examples of these dyes include compounds disclosed in JP-A-2004-250483, paragraph [0060] to [0071]. The oil-soluble dye of the general formula (Y-I) disclosed in these patents may be used not only for yellow ink but also any other color inks such as black ink and red ink.

As the magenta color dye there is preferably used a compound having the structure represented by the general formula (3) or (4) disclosed in JP-A-2002-114930. Specific examples of such a compound include those disclosed in JP-A-2002-114930, paragraph [0054] to [0073].

Particularly preferred examples of the magenta dye include azo dyes represented by the general formulae (M-1) and (M-2) disclosed in JP-A-2002-121414, paragraph [0084] to [0122]. Specific examples of the azo dye include compounds disclosed in JP-A-2002-121414, paragraph [0123] to [0132]. The oil-soluble dyes of the general formulae (3), (4), (M-1) and (M-2) disclosed in these patents may be used not only for magenta color dye but also for any other color inks such as black ink and red ink.

Preferred examples of the cyan color dye include dyes represented by the general formulae (I) to (IV) disclosed in JP-A-2001-181547, and dyes represented by the general formulae (IV-1) to (IV-4) disclosed in JP-A-2002-121414, paragraph [0063] to [0078]. Specific examples of these dyes include compounds disclosed in JP-A-2001-181547, paragraph [0052] to [0066] and JP-A-2002-121414, paragraph [0079] to [0081].

Particularly preferred examples of the cyan dye include phthalocyanine dyes represented by the general formulae (C-I) and (C-II) disclosed in JP-A-2002-121414, paragraph [0133] to [0196]1, even more preferably (C-II). Specific examples of these phthalocyanine dyes include compounds disclosed in JP-A-2002-121414, paragraph [0198] to [0201]. The oil-soluble dyes of the general formulae (I) to (IV), (IV-1) to (IV-4), (C-I) and (C-II) may be used not only for cyan color ink but also for any other color inks such as black ink and green ink.

These coloring agents are preferably incorporated in the ink composition in an amount of from 1 to 20% by weight, more preferably from 2 to 10% by weight as calculated in terms of solid content.

(Other Components)

Various additives which are used as necessary will be described hereinafter.

(Ultraviolet Absorber)

In the invention, an ultraviolet absorber may be used from the standpoint of enhancement of weathering resistance of the image obtained and prevention of fading of the image.

Examples of the ultraviolet absorber employable herein include benzotriazole-based compounds disclosed in JP-A-58-185677, JP-A-61-190537, JP-A-2-782, JP-A-5-197075 and JP-A-9-34057, benzophenone-based compounds disclosed in JP-A-46-2784, JP-A-5-194483 and U.S. Pat. No. 3,214,463, cinnamic acid-based compounds disclosed in JP-B-48-30492 (the term "JP-B" as used herein means an "examined Japanese patent application), JP-A-56-21141 and JP-A-10-88106, triazine-based compounds disclosed in JP-A-4-298503, JP-A-8-53427, JP-A-8-239368, JP-A-10-

182621 and JP-T-8-501291, and compounds which absorb ultraviolet ray to emit fluorescence, so-called fluorescent brighter, such as stilbene-based and benzoxazole-based compounds disclosed in Research Disclosure No. 24239.

The added amount of the ultraviolet absorber is properly predetermined depending on the purpose but is normally from about 0.5 to 15% by weight as calculated in terms of solid content.

(Sensitizer)

The ink composition of the invention may comprise a sensitizer incorporated therein as necessary for the purpose of enhancing the acid generation efficiency of photoacid generator and moving the wavelength of sensitivity to a longer range. As such a sensitizer there may be used any material which can sensitize the photoacid generator by-an electron moving mechanism or energy moving mechanism. Preferred examples of the sensitizer include aromatic polycondensed cyclic compounds such as anthracene, 9,10-dialkoxyanthracene, pyrene and perylene, aromatic ketone compounds such as acetophenone, benzophenone, thioxanthone and Michler's ketone, and heterocyclic compounds such as phenothiazine and N-aryloxazolidinone. The added amount of the sensitizer is properly predetermined depending on the purpose but is normally from 0.01 to 1 mol-%, preferably from 0.1 to 0.5 mol-% based on the photoacid generator.

(Oxidation Inhibitor)

The ink composition of the invention may comprise an oxidation inhibitor incorporated therein to enhance stability thereof. Examples of the oxidation inhibitor employable herein include those disclosed in European Disclosed Patent Nos. 223739, 309401, 309402, 310551, 310552 and 459416, German Disclosed Patent No. 3435443, JP-A-54-48535, JP-A-62-262047, JP-A-63-113536, JP-A-63-163351, JP-A-2-262654, JP-A-2-71262, JP-A-3-121449, JP-A-5-61166, JP-A-5-119449, U.S. Pat. Nos. 4,814,262 and 4,980,275.

The added amount of the oxidation inhibitor is properly predetermined depending on the purpose but is normally from about 0.1 to 8% by weight as calculated in terms of solid content.

(Fading Inhibitor)

The ink composition of the invention may comprise various organic or metal complex-based fading inhibitors incorporated therein. Examples of the organic fading inhibitor employable herein include hydroquinones, alkoxyphenols, dialkoxyphenols, phenols, anilines, amines, indanes, chromanes, alkoxyanilines, and heterocycles. Examples of the metal complex-based fading inhibitor employable herein include nickel complexes, and zinc complexes. In some detail, compounds disclosed in patents cited in Research Disclosure No. 17643, VII-I to J, Research Disclosure No. 15162, Research Disclosure No. 18716, left column on page 650, Research Disclosure No. 36544, page 527, Research Disclosure No. 307105, page 872, and Research Disclosure No. 15162 and compounds contained in the general formulae and examples of representative compounds disclosed in JP-A-62-215272, pp. 127-137 can be used.

The added amount of the fading inhibitor is properly predetermined depending on the purpose but is normally from about 0.1 to 8% by weight as calculated in terms of solid content.

(Electrically-conductive Salts)

The ink composition of the invention may comprise an electrically-conductive salt such as potassium thiocyanate, lithium nitrate, ammonium thiocyanate and dimethylamine hydrochloride incorporated therein for the purpose of controlling the ejectability thereof.

(Solvent)

The ink composition of the invention may also comprise an extremely slight amount of an organic solvent incorporated therein to improve the adhesion thereof to the recording medium to advantage.

Examples of the solvent employable herein include ketone-based solvents such as acetone, methyl ethyl ketone and diethyl ketone, alcohol-based solvents such as methanol, ethanol, 2-propanol, 1-propanol, 1-butanol and tert-butanol, chlorine-based solvents such as chloroform and methylene chloride, aromatic solvents such as benzene and toluene, ester-based solvents such as ethyl acetate, butyl acetate and isopropyl acetate, ether-based solvents such as diethyl ether, tetrahydrofurane and dioxane, and glycol ether-based solvents such as ethylene glycol monomethyl ether and ethylene glycol dimethyl ether.

In this case, the organic solvent is added in such an amount that no problems of solvent resistance and VOC can occur to advantage. The added amount of the solvent is preferably from 0.1 to 5% by weight, more preferably from 0.1 to 3% by weight based on the total amount of the ink composition.

(Polymer Compound)

The ink composition of the invention may comprise various polymer compounds incorporated therein to adjust the physical properties of the film. Examples of the polymer compound employable herein include acrylic polymers, polyvinyl butyral resins, polyurethane resins, polyamide resins, polyester resins, epoxy resins, phenol resins, polycarbonate resins, polyvinyl butyral resins, polyvinyl formal resins, shellac, vinyl-based resins, acrylic resins, rubber-based resins, waxes, and other natural resins. Two or more of these polymer compounds may be used in combination. Preferred among these polymer compounds are vinyl-based copolymers obtained by the copolymerization of acrylic monomers. Further, as the copolymer composition of polymer binder there is preferably used a copolymer containing a "carboxyl group-containing monomer", "methacrylic acid alkyl ester" or "acrylic acid alkyl ester" as a structural unit.

(Surface Active Agent)

The ink composition of the invention may comprise a surface active agent incorporated therein.

As the surface active agent there may be used any of those disclosed in JP-A-62-173463 and JP-A-62-183457. Examples of the surface active agent employable herein include anionic surface active agents such as dialkylsulfosuccinic acid salts, alkylnaphthalenesulfonic acid salts and aliphatic acid salts, nonionic surface active agents such as polyoxyethylene alkyl ether, polyoxyethylene alkyl allyl ether, acetylene glycol and polyoxyethylene-polyoxypropylene block copolymer, and cationic surface active agents such as alkylamine and quaternary ammonium salt. An organic fluoro compound may be used instead of the aforementioned surface active agent. The organic fluoro compound is preferably hydrophobic. Examples of the organic fluoro compound include fluorine-based surface active agents, oil-like fluorine-based compounds (e.g., fluorinated oil), and solid fluorine compound resins (e.g., ethylene tetrafluoride resin). Specific examples of these organic fluoro compounds include those disclosed in JP-A-57-9053 (columns 8 to 17) and JP-A-62-135826.

Besides these additives, a leveling agent, a matting agent, a wax for adjusting the physical properties of the film, a tackifier which doesn't inhibit polymerization to improve adhesion to recording medium such as polyolefin and PET, etc. may be incorporated in the ink composition.

Specific examples of the tackifier employable herein include high molecular tacky polymers disclosed in JP-A-2001-49200, pp. 5-6 (e.g., copolymer comprising ester of (meth) acrylic acid with alcohol having a $C_1$-$C_{20}$ alkyl group, ester of (meth) acrylic acid with $C_3$-$C_{14}$ alicyclic alcohol or ester of (meth) acrylic acid with $C_6$-$C_{14}$ aromatic alcohol), and low molecular tackifying resins having polymerizable unsaturated bond.

(Desirable Physical Properties of Ink Composition)

The ink composition of the invention preferably has a viscosity of from 7 to 30 mPa·s, more preferably from 7 to 20 mPa·s at the ejection temperature taking into account the ejectability. The composition ratio of the ink composition is preferably adjusted and predetermined such that the viscosity thereof falls within the above defined range. The viscosity of the ink composition at a temperature of from 25° C. to 30° C. is from 35 to 500 mPa·s, preferably from 35 to 200 mPa·s. When the viscosity of the ink composition at room temperature is predetermined to be a high value, the penetration of the ink into the recording medium, even if it is porous, can be prevented, making it possible to reduce the amount of monomers left uncured and eliminate odor. Further, dot bleeding during the impact of ink droplet can be prevented, resulting in the improvement of image quality. When the ink viscosity at a temperature of from 25° C. to 30° C. is less than 35 mPa·s, the resulting effect of preventing bleeding is small. On the contrary, when the ink viscosity at a temperature of from 25° C. to 30° C. is greater than 50 mPa·s, the resulting ink solution can be difficultly delivered.

The ink composition of the invention preferably has a surface tension of from 20 to 30 mN/m, more preferably from 23 to 28 mN/m. In the case where recording is made on various recording media such as polyolefin, PET, coated paper and non-coated paper, the surface tension of the ink composition of the invention is preferably 20 mN/m or more from the standpoint of bleeding and penetration or preferably 30 mN/m or less from the standpoint of wetting properties.

The ink composition of the invention thus prepared can be used as an ink for ink-jet recording. In the case where the ink composition of the invention is used as an ink for ink-jet recording, the ink composition is ejected onto the recording medium using an ink-jet printer. Thereafter, the ink composition thus dropped on the recording medium is irradiated with light energy so that it is cured to effect recording.

In the printed matter obtained from this ink, the image area is a result of curing of the ink composition by irradiation with light energy such as ultraviolet ray and thus is excellent in strength.

(Radical Polymer-based Ink Composition)

The radical polymer-based ink composition comprises a radical-polymerizable compound and a polymerization initiator. The radical polymer-based ink composition may further comprise a sensitizing dye, a coloring material, etc. as necessary.

The various components constituting the radical polymer-based ink composition will be sequentially described hereinafter.

(Radical-polymerizable Compound)

Examples of the radical-polymerizable compound include the following compounds having addition-polymerizable ethylenically unsaturated bond.

(Compound having Addition-polymerizable Ethylenically Unsaturated Bond)

Examples of the compounds having addition-polymerizable ethylenically unsaturated bond which can be incorporated in the ink composition of the invention include esters of unsaturated carboxylic acid (e.g., acrylic acid, methacrylic acid, itaconic acid, crotonic acid, isocrotonic acid, maleic acid) with aliphatic polyvalent alcohol compound, and amides of the aforementioned unsaturated carboxylic acid with aliphatic polyvalent amine compound.

Referring to specific examples of the esters of aliphatic polyvalent alcohol with unsaturated carboxylic acid, examples of acrylic acid ester include ethylene glycol diacrylate, triethylene glycol diacrylate, 1,3-butanediol diacrylate, tetramethylene glycol diacrylate; propylene glycol diacrylate, neopentyl glycol diacrylate, trimethylolpropane triacrylate, trimethylolpropane tri(acryloyloxy propyl)ether, trimethylolethane triacrylate, hexanediol diacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri (acryloyloxy ethyl)isocyanurate, and polyester acrylate oligomer.

Examples of methacrylic acid ester include tetramethylene dimethacrylate, triethylene glycol dimethacrylate, neopentyl glycol dimethacrylate, trimethylolpropane trimethacrylate, trimethylolethane trimethacrylate, ethylene glycol dimethacrylate, 1,3-butanediol dimethacrylate, hexanediol dimethacrylate, pentaerythritol dimethacrylate, dipentaerythritol dimethacrylate, dipentaerythritol hexamethacrylate, sorbitol trimethacrylate, sorbitol tetramethacrylate, bis [p-(3-methacryloxy-2-hydroxypropoxy)phenyl] dimethylmethane, and bis-[p-(acryloxyethoxy)phenyl] dimethylmethane. Examples of itaconic acid ester include ethylene glycol diitaconate, propylene glycol diitaconate, 1,3-butanediol diitaconate, 1,4-butane diol diitaconate, tetramethylene glycol diitaconate, pentaerythritol diitaconate, and sorbitol tetraitaconate.

Examples of crotonic acid ester include ethylene glycol dicrotonate, tetramethylene glycol dicrotonate, pentaerythritol dicrotonate, and sorbitol tetradicrotonate. Examples of isocrotonic acid ester include ethylene glycol diisocrotonate, pentaerythritol diisocrotonate, and sorbitol tetraisocrotonate. Examples of maleic acid ester include ethylene glycol dimaleate, triethylene glycol dimaleate, pentaerythritol dimaleate, and sorbitol tetramaleate. Mixtures of the aforementioned ester monomers may be also used. Specific examples of the monomers of amide of aliphatic polyvalent amine compound with unsaturated carboxylic acid include methylenebis-acrylamide, methylenebis-methacrylamide, 1,6-hexamethylenebis-acrylamide, 1,6-hexamethylenebis-methacrylamide, diethylenetriamine trisacrylamide, xylylene bisacrylamide, and xylylenebismethacrylamide.

Other examples of monomers include vinylurethane compounds having two or more polymerizable vinyl groups incorporated therein per molecule obtained by adding a vinyl monomer containing a hydroxyl group represented by the general formula (A): $CH_2{=}C(R)COOCH_2CH(R')OH$ (in which R and R' each represent H or $CH_3$) to a polyisocyanate compound having two or more isocyanate groups per molecule as disclosed in JP-B-48-41708.

Further examples of monomers include polyfunctional acrylates and methacrylates such as urethane acrylate as disclosed in JP-A-51-37193, polyester acrylate as disclosed in JP-A-48-64183, JP-B-49-43191 and JP-B-52-30490 and epoxy acrylates obtained by the reaction of epoxy resin with (meth) acrylic acid. Moreover, those disclosed as photosetting monomer and oligomer in "The Journal of the Adhesion Society of Japan", vol. 20, No. 7, pp. 300-308, 1984 may be used. In the invention, these monomers may be used in a chemical form such as prepolymer, i.e., dimer, trimer, oligomer, mixture and copolymer thereof.

The amount of the radically-polymerizable compound to be used is normally from 1% to 99.99%, preferably from 5% to 90.0%, more preferably from 10% to 70% based on the total amount of the components of the ink composition (The term "%" as used herein is % by weight).

(Photopolymerization Initiator)

The photopolymerization initiator to be used in the radical polymer-based ink composition of the invention will be further described hereinafter.

The photopolymerization initiator of the invention is a compound which undergoes action by light or mutual interaction with electron excitation of sensitizing dye to cause chemical change resulting in the generation of at least one of radical, acid and base.

Preferred examples of the photopolymerization initiator (a) aromatic ketones, (b) aromatic onium salt compounds, (c) organic peroxides, (d) hexaacryl biimidazole compounds, (e) ketoxime ester compounds, (f) borate compounds, (g) adinium compounds, (h) metalocene compounds, (i) active estercompounds, and (j) compounds having carbon-halogen bond.

(Sensitizing Dye)

The ink composition of the invention may also comprise a sensitizing dye incorporated therein for the purpose of enhancing the sensitivity of the photopolymerization initiator. Preferred examples of the sensitizing dye employable herein include those belonging to the following compound group having an absorption wavelength of from 350 nm to 450 nm.

Polynucleus aromatic compounds (e.g., pyrene, perylene, triphenylene), xanthenes (e.g., fluorescein, eosine, erythrosine, rhodamine B, rose bengal), cyanines (e.g., thiazarbocyanine, oxacarbocyanine), melocyanines (e.g., melocyanine, carbomelocyanine), thiazines (e.g., thionine, methylene blue, tolidine blue), acridines (e.g., acridine orange, chlroflavin, acryflavin), anthraquinones (e.g., anthraquinone), squariliums (e.g., squarilium), and coumarines (e.g., 7-diethylamino-4-methylcoumarine).

(Cosensitizer)

The ink of the invention may further comprise as a cosensitizer a known compound which acts to further enhance sensitivity or suppress the inhibition of polymerization by enzyme.

Examples of such a cosensitizer include amines such as compounds disclosed in M. R. Sander et al, "Journal of Polymer Society", vol. 10, page 3,173, 1972, JP-B-44-20189, JP-A-51-82102, JP-A-52-134692, JP-A-59-138205, JP-A-60-84305, JP-A-62-18537, JP-A-64-33104 and Research Disclosure No. 33825. Specific examples of these compounds include triethanolamine, p-dimethyl aminobenzoic acid ethyl ester, p-formyldimethylaniline, and p-methylthiodimethylaniline.

Other examples of cosensitizer include thiols and sulfides such as thiol compounds disclosed in JP-A-53-702, JP-B-55-500806 and JP-A-5-142772 and disulfide compounds disclosed in JP-A-56-75643. Specific examples of these compounds include 2-mercaptobenzothiazole, 2-mercaptobenzooxaole, 2-mercaptobenzoimidazole, 2-mercapto-4(3H)-oxazoline, and β-mercaptonaphthalene.

Further examples of cosensitizer include amino acid compounds (e.g., N-phenylglycine), organic metal compounds (e.g., tributyltin acetate) disclosed in JP-B-48-42965, hydrogen-providing materials disclosed in JP-B-55-34414, sulfur compounds (e.g., trithiane) disclosed in JP-A-6-308727, phosphorus compounds (e.g., diethyl phosphite) disclosed in JP-A-6-250387, and Si—H and Ge—H compounds disclosed in Japanese Patent Application No. 6-191605.

From the standpoint of enhancement of preservability, a polymerization inhibitor is preferably incorporated in an amount of from 200 ppm to 20,000 ppm. The ink for ink-jet recording of the invention is preferably heated to a temperature of from 40° C. to 80° C. to have a lower viscosity before being ejected. Also for the purpose of preventing clogging of the ink head by heat polymerization, a polymerization inhibitor is preferably added. Examples of the polymerization inhibitor include hydroquinone, benzoquinone, p-methoxyphenol, TEMPO, TEMPOL, and Cupferron A1.

(Others)

Besides these additives, known compounds may be used as necessary. For example, a surface active agent, a leveling agent, a matting agent, a polyester-based resin for adjusting physical properties of film, a polyurethane-based resin, a vinyl-based resin, an arylic acid, a rubber-based resin, and a wax may be properly selected. Further, in order to enhance the adhesion of the ink composition to the recording medium such as polyolefin and PET, a tackifier which doesn't inhibit polymerization is preferably incorporated in the ink composition. Specific examples of the tackifier include high molecular tacky polymers disclosed in JP-A-2001-49200, pp. 5-6 (e.g., copolymer comprising ester of (meth) acrylic acid with alcohol having a $C_1$-$C_{20}$ alkyl group, ester of (meth)acrylic acid with $C_3$-$C_{14}$ alicyclic alcohol or ester of (meth) acrylic acid with $C_6$-$C_{14}$ aromatic alcohol), and low molecular tackifying resins having polymerizable unsaturated bond.

The ink composition of the invention may also comprise an extremely slight amount of an organic solvent incorporated therein to improve the adhesion thereof to the recording medium to advantage. In this case, the organic solvent is added in such an amount that no problems of solvent resistance and VOC can occur to advantage. The added amount of the solvent is preferably from 0.1 to 5% by weight, more preferably from 0.1 to 3% by weight based on the total amount of the ink composition.

In order to prevent the drop of sensitivity due to the effect of the ink coloring material of blocking light, a cationically polymerizable monomer having a long life with polymerization initiator and a polymerization initiator are preferably combined to form a radical cation-containing hybrid type curable ink.

(Aqueous Ink Composition)

The aqueous ink composition comprises a polymerizable compound and a water-soluble photopolymerization initiator which undergoes action by light energy to produce radicals. If necessary, the aqueous ink composition may further comprise a coloring material, etc.

(Polymerizable Compound)

As the polymerizable compound being incorporated in the aqueous ink composition there may be used a polymerizable compound to be incorporated in known aqueous ink compositions.

The aqueous ink composition may comprise a reactive material incorporated therein to provide a formulation optimized taking into account end user properties such as curing rate, adhesion and flexibility. Examples of the reactive material employable herein include (meth) acrylate (i.e., acrylate and/or methacrylate) monomers and oligomers, epoxides, and oxetanes.

Examples of the acrylate monomers include phenoxyethyl acrylate, octyldecyl acrylate, tetrahydrofuryl acrylate, isobornyl acrylate, hexanediol diacrylate, trimethylolpropane triacrylate, pentaerythritol triacrylate, polyethylene glycol diacrylate (e.g., tetraethylene glycol diacrylate), dipropylene glycol diacrylate, tri(propyleneglycol) triacrylate, neopentyl glycol diacrylate, bis (pentaerythritol)hexaacrylate, acrylate of ethoxylated or propoxylated glycol (e.g., propoxylated neopentyl glycol diacrylate, ethoxylated trimethylolpropane triacrylate), and mixtures thereof.

Examples of the acrylate oligomers include ethoxylated polyethylene glycol, ethoxylated trimethylol propane acrylate, polyether acrylate, ethoxylation product thereof, and urethane acrylate oligomers.

Examples of the methacrylates include hexanediol dimethacrylate, trimethylol propane trimethacrylate, triethylene glycol dimethacrylate, diethylene glycol dimethacrylate, ethylene glycol dimethacrylate, 1,4-butanediol dimethacrylate, and mixtures thereof.

The added amount of oligomer is preferably from 1% to 80% by weight, more preferably from 1% to 10% by weight based on the total amount of the ink composition.

(Water-soluble Photopolymerization Initiator which Undergoes Action by Light Energy to Produce Radicals)

The polymerization initiator which can be used in the ink composition of the invention will be described below. An example of the polymerization initiator is a photopolymerization initiator which acts up to a wavelength of about 400 nm. Examples of such a photopolymerization initiator include photopolymerization initiators represented by the following general formulae (hereinafter referred to as "TX Series") which exhibit functionality in a long wavelength range, that is, which is sensitive-to ultraviolet ray to produce radicals. In the invention, it is particularly preferred that the photopolymerization initiator be properly selected from these examples.

TX-1

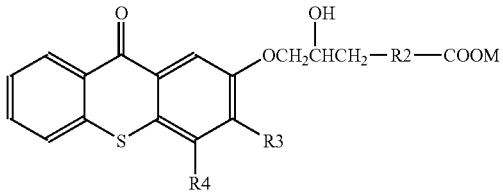

TX-2

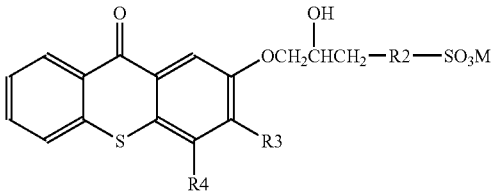

-continued

TX-3

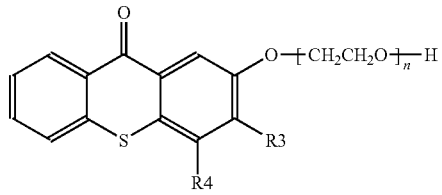

In the general formulae TX-1 to TX-3, R2 represents —$(CH_2)$x- (in which x is 0 or 1 ), —O—$(CH_2)$y- (in which y is 1 or 2) or substituted or unsubstituted phenylene group. In the case where R2 is a phenylene group, at least one of the hydrogen atoms in the benzene ring may be substituted by one or more groups or atoms selected from the group consisting of carboxyl groups or salts thereof, sulfonic acids or salts thereof, $C_1$ -$C_4$ straight-chain or branched alkyl groups, halogen atoms (e.g., fluorine, chlorine, bromine), $C_1$-$C_4$ alkoxyl groups and aryloxy groups such as phenoxy group. M represents a hydrogen atom or an alkaline metal (e.g., Li, Na, K). R3 and R4 each independently represent a hydrogen atom or a substituted or unsubstituted alkyl group. Examples of the alkyl group include straight-chain or branched alkyl groups having from about 1 to 10 carbon atoms, particularly preferably from 1 to 3 carbon atoms. Examples of substituents on these alkyl groups include halogen atoms (e.g., fluorine, chlorine, bromine), hydroxyl groups, and alkoxyl groups (having from about 1 to 3 carbon atoms) The suffix m represents an integer of from 1 to 10.

In the invention, a water-soluble derivative of the photopolymerization initiator Irgacure 2959 (Trade name; produced by Ciba Specialty Chemicals Co., Ltd.) represented by the following general formulae (hereinafter abbreviated as "IC Series") may be used. In some detail, IC-1 to IC-3 represented by the following general formulae may be used.

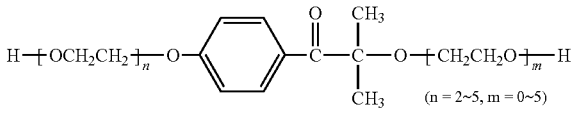

IC-1

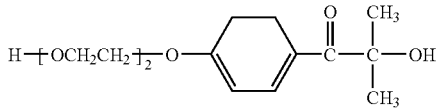

IC-2

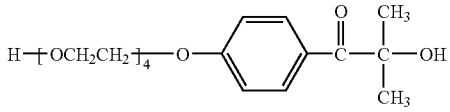

IC-3

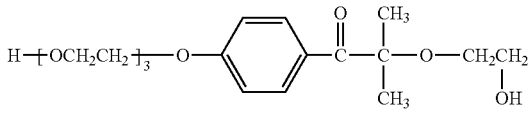

(Formulation for Clear Ink)

The aforementioned water-soluble polymerizable compound may be in the form of a transparent aqueous ink free of the aforementioned coloring materials to form a clear ink. In particular, by preparing such that ink-jet recording properties can be exhibited, an aqueous photosetting clear ink for ink-jet recording can be obtained. The use of such an ink makes it possible to obtain a clear film because it is free of coloring materials. Referring to the usage of clear ink free of coloring materials, the clear ink can be used as undercoat for providing the recording medium with adaptability to image printing or as overcoat for surface-protecting, further modifying or giving gloss to image formed by ordinary ink. The clear ink may comprise a colorless pigment or particulate material incorporated therein which is not intended for coloring. The incorporation of these pigments or particulate materials makes it possible to enhance properties such as image quality, fastness and workability (handleability) of printed matter regardless of whichever it is for undercoat or overcoat.

Referring to the formulation of such a clear ink, the ink composition is preferably prepared under the conditions such that the water-soluble polymerizable compound, which is a main component of the ink, is incorporated in an amount of from 10% to 85% and the photopolymerization initiator (e.g., ultraviolet polymerization catalyst) is incorporated in an amount of from 1 to 10 parts by weight based on 100 parts by weight of the water-soluble polymerizable compound and at least 0.5 parts by weight based on 100 parts of the ink.

(Materials Constituting Coloring Material-containing Ink)

In the case where the aforementioned water-soluble polymerizable compound is used in the ink containing coloring materials, it is preferred that the concentration of the polymerization initiator and the polymerizable materials in the ink be adjusted according to the absorption characteristics of the coloring materials incorporated in the ink. As previously mentioned, the mixing proportion of water or solvent is from 40% to 90% by weight, preferably from 60% to 75% by weight. Further, the content of the polymerizable compound in the ink is from 1% to 30% by weight, preferably from 5% to 20% by weight based on the total amount of the ink composition. Though the mixing proportion of the polymerization initiator depends on the content of the polymerizable compound, the mixing proportion of the polymerization initiator is generally from 0.1% to 7% by weight, preferably from 0.3% to 5% by weight based on the total amount of the ink composition.

In the case where as the ink coloring materials there are used pigments, the concentration of pure pigments in the ink composition is generally from 0.3% to 10% by weight based on the total amount of the ink composition. The coloring force of the pigments depends on the dispersion of pigment particles. When the concentration of the pigments falls within a range of from about 0.3% to 1%, the resulting ink can be used as a light color ink. When the concentration of the pigments exceeds the above range, the resulting ink has a pigment concentration for ordinary coloring.

The present application claims foreign priority based on Japanese Patent Application (JP 2005-209138) filed Jul. 19 of 2005, the contents of which is incorporated herein by reference.

What is claimed is:

1. An ink-jet recording device comprising:

an irradiating unit that irradiates an ultraviolet ray;

an ink-jet head that ejects an ink toward a recording medium, the ink capable of curing by the ultraviolet ray irradiated from the irradiating unit;

a conveying unit that conveys the recording medium to a position opposed to the ink-jet head; and a filter unit comprising a photocatalyst activated by the ultraviolet ray to decompose organic components of the ink, wherein the filter unit is disposed on a line in an irradiating direction of the ultraviolet ray irradiated from the irradiating unit toward the recording medium and on a side of the recording medium opposite the irradiating unit, and the filter unit is irradiated with the ultraviolet ray before and after the recording medium passes across the ultraviolet ray irradiated by the irradiating unit.

2. The ink-jet recording device as claimed in claim 1, wherein the filter unit comprises a titanium oxide.

3. An ink-jet recording device comprising:

an irradiating unit that irradiates an ultraviolet ray;

an ink-jet head that ejects an ink toward a recording medium, the ink capable of curing by the ultraviolet ray irradiated from the irradiating unit;

a conveying unit that conveys the recording medium to a position opposed to the ink-jet head;

a filter unit comprising a photocatalyst activated by the ultraviolet ray to decompose organic components of the ink; and a reflective plate that is disposed on a line in an irradiating direction of the ultraviolet ray toward the recording medium and on a side of the recording medium opposite the irradiating unit, and reflects the ultraviolet ray irradiated from the irradiating unit toward the filter unit, wherein the filter unit is disposed in the vicinity of an outlet of the recording medium, the outlet being provided the ink-jet recording device, and the reflective plate reflects the ultraviolet ray so as to irradiate the filter unit with the ultraviolet ray before and after the recording medium passes across the ultraviolet ray irradiated by the irradiating unit.

4. The ink-jet recording device as claimed in claim 3, which comprises:

a suction fan that is provided in the vicinity of the outlet of the recording medium.

5. The ink-jet recording device as claimed in claim 3, which comprises:

a suction fan that is provided in the vicinity of the ink-jet head, wherein the suction fan that flows air taken in the ink-jet recording device toward the recording medium in an ejection direction of the ink so as to surround the ink-jet head.

6. The ink-jet recording device as claimed in claim 3, wherein the filter unit comprises a titanium oxide.

* * * * *